US009466472B2

(12) United States Patent
Bateman et al.

(10) Patent No.: US 9,466,472 B2
(45) Date of Patent: Oct. 11, 2016

(54) MASS SPECTROMETER

(75) Inventors: Robert Harold Bateman, Cheshire (GB); Kevin Giles, Stockport (GB); Steven Derek Pringle, Darwen (GB)

(73) Assignee: Micromass UK Limited, Wilmslow (GB)

( * ) Notice: Subject to any disclaimer, the term of this patent is extended or adjusted under 35 U.S.C. 154(b) by 208 days.

(21) Appl. No.: 11/720,520

(22) PCT Filed: Dec. 2, 2005

(86) PCT No.: PCT/GB2005/004627

§ 371 (c)(1),
(2), (4) Date: Nov. 1, 2007

(87) PCT Pub. No.: WO2006/059123

PCT Pub. Date: Jun. 8, 2006

(65) Prior Publication Data

US 2009/0173880 A1 Jul. 9, 2009

Related U.S. Application Data

(60) Provisional application No. 60/637,706, filed on Dec. 21, 2004.

(30) Foreign Application Priority Data

Dec. 2, 2004 (GB) ..... 0426520.3

(51) Int. Cl.
*H01J 49/00* (2006.01)
*H01J 49/06* (2006.01)

(52) U.S. Cl.
CPC ..... *H01J 49/065* (2013.01)

(58) Field of Classification Search
USPC ..... 250/281, 282, 290, 292, 293, 294
See application file for complete search history.

(56) References Cited

U.S. PATENT DOCUMENTS

| | | | | |
|---|---|---|---|---|
| 5,811,820 | A | 9/1998 | Kirchner et al. | |
| 6,107,628 | A | 8/2000 | Smith et al. | |
| 6,111,250 | A | 8/2000 | Thomson et al. | |
| 6,545,268 | B1 * | 4/2003 | Verentchikov et al. | 250/287 |
| 6,794,641 | B2 | 9/2004 | Bateman et al. | |
| 7,829,849 | B2 * | 11/2010 | Giles | 250/290 |
| 9,048,073 | B2 | 6/2015 | Bateman et al. | |
| 2003/0001088 | A1 * | 1/2003 | Bateman et al. | 250/287 |
| 2004/0026614 | A1 | 2/2004 | Bateman et al. | |
| 2004/0031920 | A1 * | 2/2004 | Giles et al. | 250/287 |
| 2004/0046124 | A1 | 3/2004 | Derrick et al. | |
| 2004/0051038 | A1 | 3/2004 | Taniguchi et al. | |
| 2004/0195503 | A1 * | 10/2004 | Kim et al. | 250/288 |
| 2009/0057546 | A1 * | 3/2009 | Giles | 250/282 |

FOREIGN PATENT DOCUMENTS

| | | |
|---|---|---|
| EP | 1267387 | 12/2002 |
| GB | 2375653 | 11/2002 |
| GB | 2382920 | 6/2003 |
| GB | 2392005 | 2/2004 |
| GB | 2392548 | 3/2004 |
| JP | 11307040 | 11/1999 |
| WO | 2005/067000 | 7/2005 |

* cited by examiner

*Primary Examiner* — Nicole Ippolito
*Assistant Examiner* — Hanway Chang
(74) *Attorney, Agent, or Firm* — Diederiks & Whitelaw, PLC

(57) ABSTRACT

An ion guide is disclosed comprising one or more layers of intermediate planar, plate or mesh electrodes. A first array of first electrodes is provided on a upper surface and a second array of second electrodes is arranged on a lower surface. An ion guiding region is formed within the ion guide. One or more transient DC voltages or potentials are preferably applied to the first and second array of second electrodes in order to urge, propel, force or accelerate ions through or along the ion guide.

44 Claims, 4 Drawing Sheets

MASS SPECTROMETER

CROSS REFERENCE TO RELATED APPLICATIONS

This application is the National Stage of International Application No. PCT/GB2005/004627, filed on Dec. 2, 2005, which claims priority to and benefit of U.S. Provisional Patent Application Ser. No. 60/637,706, filed on Dec. 21, 2004, and priority to and benefit of United Kingdom Patent Application No. 0426520, filed Dec. 2, 2004. The entire contents of these applications are incorporated herein by reference.

FIELD OF THE INVENTION

The present invention relates to a device which may comprise an ion guide, an ion mobility spectrometer or separator or a collision, fragmentation or reaction device. The device preferably forms part of a mass spectrometer. The present invention also relates to a method of guiding ions, a method of ion mobility spectrometry or ion mobility separation and a method of colliding, fragmenting or reacting ions. The present invention also relates to a method of mass spectrometry, a method of manufacturing or making an ion guide, a method of manufacturing or making an ion mobility spectrometer or separator and a method of manufacturing or making a collision, fragmentation or reaction device.

The preferred embodiment relates to an ion guide comprising stack of layers of intermediate planar, plate or mesh electrodes. The ion guide further comprises an array of upper electrodes and an array of lower electrodes. One or more transient DC voltages or potentials or one or more transient DC voltage or potential waveforms are preferably applied to the array of upper electrodes and/or the array of lower electrodes in order to urge ions along and through at least a portion of the preferred ion guide.

BACKGROUND OF THE INVENTION

Multipole rod set ion guides are known comprising four, six or eight parallel rods which are equi-spaced about a circular circumference. The rods are all maintained at substantially the same DC voltage. A two-phase RF voltage is also applied to the rods with adjacent rods being supplied with opposite phases of the RF voltage. The RF voltage applied to the rods causes a symmetrical effective radial pseudo-potential well to be generated within the space circumscribed by the rods. The radial pseudo-potential well causes ions to be confined radially within the ion guide. The ion guide may be maintained at a relatively high pressure and can result in a reduction in the ion radial density distribution due to collisional cooling of ions with background gas molecules. The multipole rod set ion guide may be arranged to confine, transport and focus ions in the presence of background gas. The known rod set ion guide may be used, for example, to couple an Atmospheric Pressure ion source to a mass analyser which must be maintained at relatively low pressure.

Another form of ion guide is known which comprises a plurality or stack of ring electrodes having apertures through which ions are transmitted in use. Opposite phases of a two-phase AC or RF voltage are applied to adjacent electrodes. The ion guide may comprise an ion tunnel ion guide comprising electrodes which have apertures which are all substantially the same size or diameter. Alternatively, the ion guide may comprise an ion funnel ion guide comprising a plurality of electrodes which have apertures which progressively decrease in diameter along the axial length of the ion guide.

Another form of ion guide is known which comprises a stack or a plurality of layers of intermediate planar electrodes. The plurality of intermediate planar electrodes are bounded by a single upper planar electrode on one side and a single lower planar electrode on an opposed side. Each layer of intermediate planar electrodes comprises two longitudinal electrodes. The two longitudinal electrodes in any layer are supplied with the same phase of a two-phase RF voltage. Adjacent layers of intermediate planar electrodes are supplied with opposite phases of the two-phase RF voltage. The RF voltage applied to the layers of intermediate planar electrodes causes a pseudo-potential well to be generated which acts to confine ions between the longitudinal electrodes within the ion guide in the horizontal radial direction. Voltages are applied to the upper and lower single planar electrodes in order to confine ions within the ion guide in the vertical radial direction.

The known ion guide comprising a stack of layers of intermediate planar electrodes and single upper and lower planar electrodes is particularly advantageous compared to other known ion guides in that various complex and efficient ion transport volumes or geometries can be provided that would be otherwise be very difficult to provide using a rod set ion guide or an ion guide comprising a plurality of ring electrodes.

Ion guides comprising a stack or plurality of layers of intermediate planar electrodes can be relatively easily designed so as to transportions along relatively convoluted or potentially complex ion paths. A further advantage of an ion guide comprising a plurality of layers of intermediate planar electrodes is that the shape and/or area of the ion confinement volume can be arranged to vary along the length of the ion guide. This enables the ion guide to effectively couple two components of a mass spectrometer which may have different ion-optical acceptance profiles.

According to an arrangement an ion guide comprising a plurality of layers of intermediate planar electrodes may be arranged so that two or more separate ion guides merge into a single ion guide. Alternatively, according to another arrangement an ion guide comprising a plurality of layers of intermediate planar electrodes may be arranged so that an ion guide divides into two or more separate ion guides.

The known ion guide comprising a plurality of layers of intermediate planar electrodes and single upper and lower planar electrodes suffers from the problem that collisions between ions and background gas molecules present within the ion guide may reduce the kinetic energy of the ions as they pass through the ion guide. This can have the effect of increasing the transit times of ions as they pass through the ion guide.

SUMMARY OF THE INVENTION

According to an aspect of the present invention there is provided a device comprising:

one or more layers of intermediate planar, plate or mesh electrodes arranged generally or substantially in a plane in which ions travel in use;

a first array of first electrodes disposed on a first side of the one or more layers of layers of intermediate planar, plate or mesh electrodes; and voltage means arranged and adapted to apply one or more voltages or one or more voltage waveforms to the first array of first electrodes in order to urge, propel, force or accelerate at least some ions through and/or along at least a portion of the device.

The first array of first electrodes preferably comprises at least 2, 3, 4, 5, 6, 7, 8, 9, 10, 11, 12, 13, 14, 15, 16, 17, 18, 19, 20 or more than 20 electrodes.

The first array of first electrodes may comprise: (i) a printed circuit board, printed wiring board or etched wiring board; (ii) a plurality of conductive traces applied or laminated onto a non-conductive substrate; (iii) a plurality of copper or metallic electrodes arranged on a substrate; (iv) a screen printed, photoengraved, etched or milled printed circuit board; (v) a plurality of electrodes arranged on a paper substrate impregnated with phenolic resin; (vi) a plurality of electrodes arranged on a fibreglass mat impregnated within an epoxy resin; (vii) a plurality of electrodes arranged on a plastic substrate; or (viii) a plurality of electrodes arranged on a substrate.

According to an embodiment at least 5%, 10%, 15%, 20%, 25%, 30%, 35%, 40%, 45%, 50%, 55%, 60%, 65%, 70%, 75%, 80%, 85%, 90%, 95% or 100% of the first electrodes have an axial centre to centre spacing selected from the group consisting of: (i) <1 mm; (ii) 1-2 mm; (iii) 2-3 mm; (iv) 3-4 mm; (v) 4-5 mm; (vi) 5-6 mm; (vii) 6-7 mm; (viii) 7-8 mm; (ix) 8-9 mm; (x) 9-10 mm; (xi) 10-11 mm; (xii) 11-12 mm; (xiii) 12-13 mm; (xiv) 13-14 mm; (xv) 14-15 mm; (xvi) 15-16 mm; (xvii) 16-17 mm; (xviii) 17-18 mm; (xix) 18-19 mm; (xx) 19-20 mm; and (xxi) >20 mm.

At least 5%, 10%, 15%, 20%, 25%, 30%, 35%, 40%, 45%, 50%, 55%, 60%, 65%, 70%, 75%, 80%, 85%, 90%, 95% or 100% of the first electrodes preferably have an axial length selected from the group consisting of: (i) <1 mm; (ii) 1-2 mm; (iii) 2-3 mm; (iv) 3-4 mm; (v) 4-5 mm; (vi) 5-6 mm; (vii) 6-7 mm; (viii) 7-8 mm; (ix) 8-9 mm; (x) 9-10 mm; (xi) 10-11 mm; (xii) 11-12 mm; (xiii) 12-13 mm; (xiv) 13-14 mm; (xv) 14-15 mm; (xvi) 15-16 mm; (xvii) 16-17 mm; (xviii) 17-18 mm; (xix) 18-19 mm; (xx) 19-20 mm; and (xxi) >20 mm.

According to an embodiment at least 5%, 10%, 15%, 20%, 25%, 30%, 35%, 40%, 45%, 50%, 55%, 60%, 65%, 70%, 75%, 80%, 85%, 90%, 95% or 100% of the first electrodes have a width selected from the group consisting of: (i) <1 mm; (ii) 1-2 mm; (iii) 2-3 mm; (iv) 3-4 mm; (v) 4-5 mm; (vi) 5-6 mm; (vii) 6-7 mm; (viii) 7-8 mm; (ix) 8-9 mm; (x) 9-10 mm; (xi) 10-11 mm; (xii) 11-12 mm; (xiii) 12-13 mm; (xiv) 13-14 mm; (xv) 14-15 mm; (xvi) 15-16 mm; (xvii) 16-17 mm; (xviii) 17-18 mm; (xix) 18-19 mm; (xx) 19-20 mm; and (xxi) >20 mm.

The first electrodes preferably have a thickness selected from the group consisting of: (i) <0.01 mm; (ii) 0.01-0.1 mm; (iii) 0.1-0.2 mm; (iv) 0.2-0.3 mm; (v) 0.3-0.4 mm; (vi) 0.4-0.5 mm; (vii) 0.5-0.6 mm; (viii) 0.6-0.7 mm; (ix) 0.7-0.8 mm; (x) 0.8-0.9 mm; (xi) 0.9-1.0 mm; (xii) 1-2 mm; (xiii) 2-3 mm; (xiv) 3-4 mm; (xv) 4-5 mm; and (xvi) >5 mm.

At least 5%, 10%, 15%, 20%, 25%, 30%, 35%, 40%, 45%, 50%, 55%, 60%, 65%, 70%, 75%, 80%, 85%, 90%, 95% or 100% of the first electrodes are preferably biased, in use, at a first bias DC voltage or potential with respect to the mean or average voltage or potential of at least some or all of the intermediate planar, plate or mesh electrodes. The first DC bias voltage or potential is preferably selected from the group consisting of: (i) less than −10V; (ii) −9 to −8V; (iii) −8 to −7V; (iv) −7 to −6V; (v) −6 to −5V; (vi) −5 to −4V; (vii) −4 to −3V; (viii) −3 to −2V; (ix) −2 to −1V; (x) −1 to 0V; (xi) 0 to 1V; (xii) 1 to 2V; (xiii) 2 to 3V; (xiv) 3 to 4V; (xv) 4 to 5V; (xvi) 5 to 6V; (xvii) 6 to 7V; (xviii) 7 to 8V; (xix) 8 to 9V; (xx) 9 to 10V; and (xxi) more than 10V.

According to an embodiment the first array of first electrodes are preferably supplied in a mode of operation with a DC only voltage. Alternatively, the first array of first electrodes may be supplied in a mode of operation with an AC or RF only voltage. According to another embodiment, the first array of first electrodes may be supplied in a mode of operation with a DC and an AC or RF voltage.

According to the preferred embodiment the voltage means is preferably arranged and adapted to apply one or more transient DC voltages or potentials or one or more transient DC voltage or potential waveforms to the first array of first electrodes in order to urge, propel, force or accelerate at least some ions through and/or along at least a portion or at least 5%, 10%, 15%, 20%, 25%, 30%, 35%, 40%, 45%, 50%, 55%, 60%, 65%, 70%, 75%, 80%, 85%, 90%, 95% or 100% of the device.

The voltage means may be arranged and adapted to apply one or more substantially constant DC voltages or potentials to the first array of first electrodes in order to urge, propel, force or accelerate at least some ions through and/or along at least a portion or at least 5%, 10%, 15%, 20%, 25%, 30%, 35%, 40%, 45%, 50%, 55%, 60%, 65%, 70%, 75%, 80%, 85%, 90%, 95% or 100% of the device. A non-zero DC potential or voltage gradient is preferably maintained along at least a portion of the device.

According to an alternative embodiment the voltage means may be arranged and adapted to apply two or more phase-shifted AC or RF voltages to the first array of first electrodes in order to urge, propel, force or accelerate at least some ions through and/or along at least a portion or at least 5%, 10%, 15%, 20%, 25%, 30%, 35%, 40%, 45%, 50%, 55%, 60%, 65%, 70%, 75%, 80%, 85%, 90%, 95% or 100% of the device.

According to a preferred embodiment the device preferably further comprises a second array of second electrodes disposed on a second different and/or opposed side of the one or more layers of intermediate planar, plate or mesh electrodes to the first array of first electrodes.

The voltage means is preferably arranged and adapted to also apply one or more voltages or one or more voltage waveforms to the second array of second electrodes in order to urge, propel, force or accelerate at least some ions through and/or along at least a portion of the device.

The second array of second electrodes preferably comprises at least 2, 3, 4, 5, 6, 7, 8, 9, 10, 11, 12, 13, 14, 15, 16, 17, 18, 19, 20 or more than 20 electrodes.

The second array of second electrodes may comprise: (i) a printed circuit board, printed wiring board or etched wiring board; (ii) a plurality of conductive traces applied or laminated onto a non-conductive substrate; (iii) a plurality of copper or metallic electrodes arranged on a substrate; (iv) a screen printed, photoengraved, etched or milled printed circuit board; (v) a plurality of electrodes arranged on a paper substrate impregnated with phenolic resin; (vi) a plurality of electrodes arranged on a fibreglass mat impregnated within an epoxy resin; (vii) a plurality of electrodes arranged on a plastic substrate; or (viii) a plurality of electrodes arranged on a substrate.

At least 5%, 10%, 15%, 20%, 25%, 30%, 35%, 40%, 45%, 50%, 55%, 60%, 65%, 70%, 75%, 80%, 85%, 90%, 95% or 100% of the second electrodes preferably have an axial centre to centre spacing selected from the group consisting of: (i) <1 mm; (ii) 1-2 mm; (iii) 2-3 mm; (iv) 3-4 mm; (v) 4-5 mm; (vi) 5-6 mm; (vii) 6-7 mm; (viii) 7-8 mm; (ix) 8-9 mm; (x) 9-10 mm; (xi) 10-11 mm; (xii) 11-12 mm; (xiii) 12-13 mm; (xiv) 13-14 mm; (xv) 14-15 mm; (xvi)

15-16 mm; (xvii) 16-17 mm; (xviii) 17-18 mm; (xix) 18-19 mm; (xx) 19-20 mm; and (xxi) >20 mm.

At least 5%, 10%, 15%, 20%, 25%, 30%, 35%, 40%, 45%, 50%, 55%, 60%, 65%, 70%, 75%, 80%, 85%, 90%, 95% or 100% of the second electrodes preferably have an axial length selected from the group consisting of: (i) <1 mm; (ii) 1-2 mm; (iii) 2-3 mm; (iv) 3-4 mm; (v) 4-5 mm; (vi) 5-6 mm; (vii) 6-7 mm; (viii) 7-8 mm; (ix) 8-9 mm; (x) 9-10 mm; (xi) 10-11 mm; (xii) 11-12 mm; (xiii) 12-13 mm; (xiv) 13-14 mm; (xv) 14-15 mm; (xvi) 15-16 mm; (xvii) 16-17 mm; (xviii) 17-18 mm; (xix) 18-19 mm; (xx) 19-20 mm; and (xxi) >20 mm.

According to an embodiment at least 5%, 10%, 15%, 20%, 25%, 30%, 35%, 40%, 45%, 50%, 55%, 60%, 65%, 70%, 75%, 80%, 85%, 90%, 95% or 100% of the second electrodes have a width selected from the group consisting of: (i) <1 mm; (ii) 1-2 mm; (iii) 2-3 mm; (iv) 3-4 mm; (v) 4-5 mm; (vi) 5-6 mm; (vii) 6-7 mm; (viii) 7-8 mm; (ix) 8-9 mm; (x) 9-10 mm; (xi) 10-11 mm; (xii) 11-12 mm; (xiii) 12-13 mm; (xiv) 13-14 mm; (xv) 14-15 mm; (xvi) 15-16 mm; (xvii) 16-17 mm; (xviii) 17-18 mm; (xix) 18-19 mm; (xx) 19-20 mm; and (xxi) >20 mm.

The second electrodes preferably have a thickness selected from the group consisting of: (i) <0.01 mm; (ii) 0.01-0.1 mm; (iii) 0.1-0.2 mm; (iv) 0.2-0.3 mm; (v) 0.3-0.4 mm; (vi) 0.4-0.5 mm; (vii) 0.5-0.6 mm; (viii) 0.6-0.7 mm; (ix) 0.7-0.8 mm; (x) 0.8-0.9 mm; (xi) 0.9-1.0 mm; (xii) 1-2 mm; (xiii) 2-3 mm; (xiv) 3-4 mm; (xv) 4-5 mm; and (xvi) >5 mm.

At least 5%, 10%, 15%, 20%, 25%, 30%, 35%, 40%, 45%, 50%, 55%, 60%, 65%, 70%, 75%, 80%, 85%, 90%, 95% or 100% of the second electrodes are preferably biased, in use, at a second bias DC voltage or potential with respect to the mean or average voltage or potential of at least some or all of the planar, plate or mesh electrodes. The second DC bias voltage or potential is preferably selected from the group consisting of: (i) less than −10V; (ii) −9 to −8V; (iii) −8 to −7V; (iv) −7 to −6V; (v) −6 to −5V; (vi) −5 to −4V; (vii) −4 to −3V; (viii) −3 to −2V; (ix) −2 to −1V; (x) −1 to 0V; (xi) 0 to 1V; (xii) 1 to 2V; (xiii) 2 to 3V; (xiv) 3 to 4V; (xv) 4 to 5V; (xvi) 5 to 6V; (xvii) 6 to 7V; (xviii) 7 to 8V; (xix) 8 to 9V; (xx) 9 to 10V; and (xxi) more than 10V.

According to an embodiment the second array of second electrodes are supplied in a mode of operation with a DC only voltage. Alternatively, the second array of second electrodes may be supplied in a mode of operation with an AC or RF only voltage. According to another embodiment the second array of second electrodes may be supplied in a mode of operation with a DC and an AC or RF voltage.

According to the preferred embodiment the voltage means is preferably also arranged and adapted to apply one or more transient DC voltages or potentials or one or more transient DC voltage or potential waveforms to the second array of second electrodes in order to urge, propel, force or accelerate at least some ions through and/or along at least a portion or at least 5%, 10%, 15%, 20%, 25%, 30%, 35%, 40%, 45%, 50%, 55%, 60%, 65%, 70%, 75%, 80%, 85%, 90%, 95% or 100% of the device.

According to another embodiment the voltage means is preferably arranged and adapted to apply one or more substantially constant DC voltages or potentials to the second array of second electrodes in order to urge, propel, force or accelerate at least some ions through and/or along at least a portion or at least 5%, 10%, 15%, 20%, 25%, 30%, 35%, 40%, 45%, 50%, 55%, 60%, 65%, 70%, 75%, 80%, 85%, 90%, 95% or 100% of the device. A non-zero DC potential or voltage gradient is preferably maintained along at least a portion of the device.

According to an embodiment the voltage means may be arranged and adapted to apply two or more phase-shifted AC or RF voltages or potentials to the second array of second electrodes in order to urge, propel, force or accelerate at least some ions through and/or along at least a portion or at least 5%, 10%, 15%, 20%, 25%, 30%, 35%, 40%, 45%, 50%, 55%, 60%, 65%, 70%, 75%, 80%, 85%, 90%, 95% or 100% of the device.

According to an embodiment of the present invention, the device may comprise means for maintaining a non-zero DC voltage or potential gradient along at least a portion or at least 5%, 10%, 15%, 20%, 25%, 30%, 35%, 40%, 45%, 50%, 55%, 60%, 65%, 70%, 75%, 80%, 85%, 90%, 95% or 100% of the axial length of the device.

The non-zero DC voltage or potential gradient may cause ions to be accelerated along at least a portion or at least 5%, 10%, 15%, 20%, 25%, 30%, 35%, 40%, 45%, 50%, 55%, 60%, 65%, 70%, 75%, 80%, 85%, 90%, 95% or 100% of the axial length of the device.

Alternatively, the non-zero DC voltage or potential gradient may present a potential barrier or hill which acts to oppose the onward transmission of ions or which acts to decelerate ions. The non-zero DC voltage or potential gradient being maintained along at least a portion or at least 5%, 10%, 15%, 20%, 25%, 30%, 35%, 40%, 45%, 50%, 55%, 60%, 65%, 70%, 75%, 80%, 85%, 90%, 95% or 100% of the axial length of the device. According to an embodiment the non-zero DC voltage or potential gradient which opposes the onward transmission of ions may be maintained across a relatively short distance e.g. <5% of the axial length of the device. It is contemplated that the non-zero DC voltage or potential gradient which opposes the onward transmission of ions may be maintained only across <4%, <3%, <2% or <1% of the axial length of the device.

According to a preferred aspect of the present invention the voltage means may be arranged to cause ions to overcome the effects of the non-zero DC voltage or potential gradient so that at least a portion or at least 5%, 10%, 15%, 20%, 25%, 30%, 35%, 40%, 45%, 50%, 55%, 60%, 65%, 70%, 75%, 80%, 85%, 90%, 95% or 100% of ions within the device are onwardly transmitted across or through the non-zero DC voltage or potential gradient. For example, a potential barrier may be maintained across a portion of the device which opposes the onward transmission of ions and one or more transient DC voltages or potentials or one or more transient DC voltage or potential waveforms may be applied to the upper and/or lower electrodes in order to urge, force, propel, or accelerate ions to overcome the potential barrier and hence to be onwardly transmitted.

According to an embodiment the one or more layers of intermediate planar, plate or mesh electrodes may comprise 1, 2, 3, 4, 5, 6, 7, 8, 9, 10, 11, 12, 13, 14, 15, 16, 17, 18, 19, 20 or more than 20 layers of intermediate planar, plate or mesh electrodes. Each layer of intermediate planar, plate or mesh electrodes preferably comprises two or more longitudinal electrodes.

According to an embodiment at least one or at least two of the longitudinal electrodes preferably have a centre to centre separation in a width direction selected from the group consisting of: (i) <1 mm; (ii) 1-2 mm; (iii) 2-3 mm; (iv) 3-4 mm; (v) 4-5 mm; (vi) 5-6 mm; (vii) 6-7 mm; (viii) 7-8 mm; (ix) 8-9 mm; (x) 9-10 mm; (xi) 10-11 mm; (xii) 11-12 mm; (xiii) 12-13 mm; (xiv) 13-14 mm; (xv) 14-15 mm; (xvi) 15-16 mm; (xvii) 16-17 mm; (xviii) 17-18 mm; (xix) 18-19 mm; (xx) 19-20 mm; and (xxi) >20 mm.

Preferably, at least one or at least two of the longitudinal electrodes have an axial length selected from the group consisting of: (i) <10 mm; (ii) 10-20 mm; (iii) 20-30 mm; (iv) 30-40 mm; (v) 40-50 mm; (vi) 50-60 mm; (vii) 60-70 mm; (viii) 70-80 mm; (ix) 80-90 mm; (x) 90-100 mm; (xi) 100-110 mm; (xii) 110-120 mm; (xiii) 120-130 mm; (xiv) 130-140 mm; (xv) 140-150 mm; (xvi) 150-160 mm; (xvii) 160-170 mm; (xviii) 170-180 mm; (xix) 180-190 mm; (xx) 190-200 mm; and (xxi) >200 mm.

According to an embodiment at least one or at least two of the longitudinal electrodes have a width selected from the group consisting of: (i) <1 mm; (ii) 1-2 mm; (iii) 2-3 mm; (iv) 3-4 mm; (v) 4-5 mm; (vi) 5-6 mm; (vii) 6-7 mm; (viii) 7-8 mm; (ix) 8-9 mm; (x) 9-10 mm; (xi) 10-11 mm; (xii) 11-12 mm; (xiii) 12-13 mm; (xiv) 13-14 mm; (xv) 14-15 mm; (xvi) 15-16 mm; (xvii) 16-17 mm; (xviii) 17-18 mm; (xix) 18-19 mm; (xx) 19-20 mm; and (xxi) >20 mm. Preferably, at least one or at least two of the longitudinal electrodes have a thickness selected from the group consisting of: (i) <0.01 mm; (ii) 0.01-0.1 mm; (iii) 0.1-0.2 mm; (iv) 0.2-0.3 mm; (v) 0.3-0.4 mm; (vi) 0.4-0.5 mm; (vii) 0.5-0.6 mm; (viii) 0.6-0.7 mm; (ix) 0.7-0.8 mm; (x) 0.8-0.9 mm; (xi) 0.9-1.0 mm; (xii) 1-2 mm; (xiii) 2-3 mm; (xiv) 3-4 mm; (xv) 4-5 mm; and (xvi) >5 mm.

The two or more longitudinal electrodes are preferably substantially co-planar.

According to the preferred embodiment the two or more longitudinal electrodes in a layer of intermediate planar, plate or mesh electrodes are supplied, in use, with substantially the same phase of a two-phase or multi-phase AC or RF voltage or signal. Adjacent layers of planar, plate or mesh electrodes in the vertical direction are preferably supplied with opposite or different phases of the AC or RF voltage or signal. The AC or RF voltage or signal preferably has a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz. The amplitude of the AC or RF voltage or signal is preferably selected from the group consisting of: (i) <50V peak to peak; (ii) 50-100V peak to peak; (iii) 100-150V peak to peak; (iv) 150-200V peak to peak; (v) 200-250V peak to peak; (vi) 250-300V peak to peak; (vii) 300-350V peak to peak; (viii) 350-400V peak to peak; (ix) 400-450V peak to peak; (x) 450-500V peak to peak; and (xi) >500V peak to peak.

According to an embodiment at least 5%, 10%, 15%, 20%, 25%, 30%, 35%, 40%, 45%, 50%, 55%, 60%, 65%, 70%, 75%, 80%, 85%, 90%, 95% or 100% of the intermediate planar, plate or mesh electrodes are supplied with an AC or RF voltage or signal. At least 5%, 10%, 15%, 20%, 25%, 30%, 35%, 40%, 45%, 50%, 55%, 60%, 65%, 70%, 75%, 80%, 85%, 90%, 95% or 100% of the layers of intermediate planar, plate or mesh electrodes are preferably arranged substantially parallel to one another.

According to an embodiment at least 5%, 10%, 15%, 20%, 25%, 30%, 35%, 40%, 45%, 50%, 55%, 60%, 65%, 70%, 75%, 80%, 85%, 90%, 95% or 100% of the layers of intermediate planar, plate or mesh electrodes are substantially planar or flat and the device curves in the plane of the electrodes.

According to another embodiment at least 5%, 10%, 15%, 20%, 25%, 30%, 35%, 40%, 45%, 50%, 55%, 60%, 65%, 70%, 75%, 80%, 85%, 90%, 95% or 100% of the layers of intermediate planar, plate or mesh electrodes are substantially non-planar or non-flat such that the electrodes curve upwards or downwards along their axial length. It is contemplated that the electrodes may curve in some other manner.

At least 5%, 10%, 15%, 20%, 25%, 30%, 35%, 40%, 45%, 50%, 55%, 60%, 65%, 70%, 75%, 80%, 85%, 90%, 95% or 100% of the layers of intermediate planar, plate or mesh electrodes are preferably arranged substantially equidistant from one another.

At least 5%, 10%, 15%, 20%, 25%, 30%, 35%, 40%, 45%, 50%, 55%, 60%, 65%, 70%, 75%, 80%, 85%, 90%, 95% or 100% of the layers of intermediate planar, plate or mesh electrodes are preferably spaced apart from one another by a distance selected from the group consisting of: (i) less than or equal to 5 mm; (ii) less than or equal to 4.5 mm; (iii) less than or equal to 4 mm; (iv) less than or equal to 3.5 mm; (v) less than or equal to 3 mm; (vi) less than or equal to 2.5 mm; (vii) less than or equal to 2 mm; (viii) less than or equal to 1.5 mm; (ix) less than or equal to 1 mm; (x) less than or equal to 0.8 mm; (xi) less than or equal to 0.6 mm; (xii) less than or equal to 0.4 mm; (xiii) less than or equal to 0.2 mm; (xiv) less than or equal to 0.1 mm; and (xv) less than or equal to 0.25 mm.

According to the preferred embodiment the device preferably has a substantially linear ion guiding region. According to an alternative embodiment the device may have a substantially curved ion guiding region.

The device may have an entrance for receiving ions along a first axis and an exit from which ions emerge from the device along a second axis, wherein the second axis makes an angle θ to the first axis, and wherein θ falls within a range selected from the group consisting of: (i) <10°; (ii) 10-20°; (iii) 20-30°; (iv) 30-40°; (v) 40-50°; (vi) 50-60°; (vii) 60-70°; (viii) 70-80°; (ix) 80-90°; (x) 90-100°; (xi) 100-110°; (xii) 110-120°; (xiii) 120-130°; (xiv) 130-140°; (xv) 140-150°; (xvi) 150-160°; (xvii) 160-170°; and (xviii) 170-180°.

The device may comprise an ion guiding region arranged between an ion entrance of the device and an ion exit of the device, and wherein the ion guiding region is substantially linear, curved, "S"-shaped or has one or more points of inflexion.

The device may have one or more separate entrances for receiving ions and one or more separate exits from which ions may emerge from the device. According to a preferred embodiment the device may comprise a Y-shaped arrangement wherein two separate ion guides merge into a single ion guide or alternatively a single ion guide diverges into two separate ion guides. According to another embodiment the device may comprise an X-shaped arrangement wherein two separate ion guides cross over to form two separate ion guides.

According to a preferred embodiment the device may have an entrance having a first cross-sectional profile and a first cross-sectional area and an exit having a second cross-sectional profile and a second cross-sectional area. The first cross-sectional profile may be different to the second cross-sectional profile and/or the first cross-sectional area may be different to the second cross-sectional area. The first cross-sectional profile and/or the second cross-sectional profile may have a substantially circular, oval, rectangular or square cross-section.

The device may be arranged and adapted to be coupled to an ion-optical component selected from the group consisting of: (i) an ion-optical component having a substantially circular, square, rectangular or elliptical cross-sectional profile; (ii) a quadrupole mass filter/analyser having a substantially circular or elliptical cross-sectional profile; (iii) an orthogonal acceleration Time of Flight mass analyser having a substantially square or rectangular cross-sectional profile; (iv) a magnetic sector analyser having a substantially rectangular cross-sectional profile; (v) a Fourier Transform Ion Cyclotron Resonance ("FTICR") mass analyser having a substantially circular or elliptical cross-sectional profile; (vi) a 2D (linear) quadrupole ion trap having a substantially circular or elliptical cross-sectional profile; and (vii) a 3D (Paul) quadrupole ion trap having a substantially circular or elliptical cross-sectional profile.

The device may comprise an ion guiding region arranged between an entrance and an exit, and wherein the ion guiding region either: (i) varies in size and/or shape along the length of the ion guiding region; or (ii) has a width and/or height which progressively tapers or enlarges in size.

The device may be maintained, in use, at a pressure selected from the group consisting of: (i) >0.0001 mbar; (ii) >0.001 mbar; (iii) >0.01 mbar; (iv) >0.1 mbar; (v) >1 mbar; (vi) >10 mbar; (vii) >100 mbar; (viii) 0.0001-0.001 mbar; (ix) 0.001-0.01 mbar; (x) 0.01-0.1 mbar; (xi) 0.1-1 mar; (xii) 1-10 mbar; (xiii) 10-100 mbar; and (xiv) 100-1000 mbar.

The device may be maintained, in use, at a pressure selected from the group consisting of: (i) <0.0001 mbar; (ii) <0.001 mbar; (iii) <0.01 mbar; (iv) <0.1 mbar; (v) <1 mbar; (vi) <10 mbar; (vii) >100 mbar; (viii) 0.0001-100 mbar; (ix) 0.001-10 mbar; and (x) 0.01-1 mbar.

According to the preferred embodiment the device preferably comprises an ion guide.

According to an alternative embodiment the device may comprise an ion mobility spectrometer or separator, preferably a gas phase electrophoresis device. According to this embodiment the voltages applied to the upper and/or lower electrodes preferably result in an axial DC voltage or potential gradient which in combination with a relatively high gas pressure causes ions to become temporally separated according to their ion mobility. Ions having a relatively high ion mobility will pass more quickly through the device than ions having a relatively low ion mobility. Alternatively, one or more transient DC voltages or potentials or one or more transient DC voltage or potential waveforms may be applied to the upper and/or lower electrodes. The one or more transient DC voltages or potentials or one or more transient DC voltage or potential waveforms applied to the upper and/or lower electrodes may have a relatively low amplitude. As a result, ions having a relatively high ion mobility may slip or pass over the relatively low amplitude potential hill as it is translated along the length of the device. However, ions having a relatively low ion mobility may be urged along the device by the relatively low amplitude potential hill. Ions are therefore preferably temporally separated according to their ion mobility.

It is also contemplated that a device substantially similar to the preferred ion guide may be provided wherein ions are separated according to another physico-chemical property other than ion mobility. For example, ions may be separated according to their mass to charge ratio or on the basis of their rate of change of ion mobility with electric field strength. It is contemplated therefore that a Field Asymmetric Ion Mobility Spectrometry or "FAIMS" device may also be provided having the same structure as the preferred ion guide.

According to another embodiment the device may comprise a collision, fragmentation or reaction device. The device may be arranged and adapted to fragment ions by Collision Induced Dissociation ("CID"). According to this embodiment, ions may be accelerated such that they have a relatively high kinetic energy when they enter the device that they are caused to fragment into fragment or daughter ions upon colliding with gas molecules in the device. Alternatively and/or additionally, ions may accelerated within the device such that they collide energetically with background gas molecules within the device and fragment into fragment or daughter ions.

Alternatively, the collision, fragmentation or reaction device may selected from the group consisting of: (i) a Surface Induced Dissociation ("SID") fragmentation device; (ii) an Electron Transfer Dissociation fragmentation device; (iii) an Electron Capture Dissociation fragmentation device; (iv) an Electron Collision or Impact Dissociation fragmentation device; (v) a Photo Induced Dissociation ("PID") fragmentation device; (vi) a Laser Induced Dissociation fragmentation device; (vii) an infrared radiation induced dissociation device; (viii) an ultraviolet radiation induced dissociation device; (ix) a nozzle-skimmer interface fragmentation device; (x) an in-source fragmentation device; (xi) an ion-source Collision Induced Dissociation fragmentation device; (xii) a thermal or temperature source fragmentation device; (xiii) an electric field induced fragmentation device; (xiv) a magnetic field induced fragmentation device; (xv) an enzyme digestion or enzyme degradation fragmentation device; (xvi) an ion-ion reaction fragmentation device; (xvii) an ion-molecule reaction fragmentation device; (xviii) an ion-atom reaction fragmentation device; (xix) an ion-metastable ion reaction fragmentation device; (xx) an ion-metastable molecule reaction fragmentation device; (xxi) an ion-metastable atom reaction fragmentation device; (xxii) an ion-ion reaction device for reacting ions to form adduct or product ions; (xxiii) an ion-molecule reaction device for reacting ions to form adduct or product ions; (xxiv) an ion-atom reaction device for reacting ions to form adduct or product ions; (xxv) an ion-metastable ion reaction device for reacting ions to form adduct or product ions; (xxvi) an ion-metastable molecule reaction device for reacting ions to form adduct or product ions; and (xxvii) an ion-metastable atom reaction device for reacting ions to form adduct or product ions.

A reaction device should be understood as comprising a device wherein ions, atoms or molecules are rearranged or reacted so as to form a new species of ion, atom or molecule. An X-Y reaction fragmentation device should be understood as meaning a device wherein X and Y combine to form a product which then fragments. This is different to a fragmentation device per se wherein ions may be caused to fragment without first forming a product. An X-Y reaction device should be understood as meaning a device wherein X and Y combine to form a product and wherein the product does not necessarily then fragment.

A plurality of insulator layers may be interspersed or interleaved between the one or more layers of intermediate planar, plate or mesh electrodes and optionally also between the intermediate planar, plate or mesh electrodes and the upper and/or lower array of electrodes.

At least 5%, 10%, 15%, 20%, 25%, 30%, 35%, 40%, 45%, 50%, 55%, 60%, 65%, 70%, 75%, 80%, 85%, 90%, 95% or 100% of the one or more layers of intermediate planar, plate or mesh electrodes may be arranged on or are deposited on the insulator layers.

According to an embodiment in a mode of operation the device is arranged and adapted to transmit ions in a first axial direction. In another mode of operation the device may be arranged and adapted to transmit ions in a second axial direction, wherein the second axial direction forms an angle $\alpha$ to the first axial direction, and wherein $\alpha$ is selected from the group consisting of: (i) <10°; (ii) 10-20°; (iii) 20-30°; (iv) 30-40°; (v) 40-50°; (vi) 50-60°; (vii) 60-70°; (viii) 70-80°; (ix) 80-90°; (x) 90-100°; (xi) 100-110°; (xii) 110-120°; (xiii) 120-130°; (xiv) 130-140°; (xv) 140-150°; (xvi) 150-160°; (xvii) 160-170°; (xviii) 170-180°; and (xix) substantially 180°.

A preferred aspect of the device is that it may be arranged and adapted to receive a substantially continuous beam of ions and the device may release or eject ions as a plurality of packets or bunches of ions. The device or ion guide may be arranged and adapted to convert a substantially continuous beam of ions into a pulsed or discontinuous beam of ions.

According to another aspect of the present invention there is provided a mass spectrometer comprising one or more devices as described above. The mass spectrometer preferably further comprises an ion source. The ion source may be selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; and (xviii) a Thermospray ion source.

The ion source may comprise a pulsed or continuous ion source.

A mass analyser is preferably arranged downstream of the device. The mass analyser may be selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic or orbitrap mass analyser; (x) a Fourier Transform electrostatic or orbitrap mass analyser; (xi) a Fourier Transform mass analyser; (xii) a Time of Flight mass analyser; (xiii) an axial acceleration Time of Flight mass analyser; and (xiv) an orthogonal acceleration Time of Flight mass analyser.

The mass spectrometer may further comprise one or more mass or mass to charge ratio filters and/or mass analysers arranged upstream and/or downstream of the device. The one or more mass or mass to charge ratio filters and/or analysers may be selected from the group consisting of: (i) a quadrupole mass filter or analyser; (ii) a Wien filter; (iii) a magnetic sector mass filter or analyser; (iv) a velocity filter; and (v) an ion gate.

According to an aspect of the present invention there is provided a method of guiding ions comprising:

providing a device comprising one or more layers of intermediate planar, plate or mesh electrodes arranged generally or substantially in the plane in which ions travel;

providing a first array of first electrodes disposed on a first side of the one or more layers of intermediate planar, plate or mesh electrodes; and applying one or more voltages or one or more voltage waveforms to the first array of first electrodes in order to urge, propel, force or accelerate at least some ions through and/or along at least a portion of the device.

The method preferably further comprises passing or guiding ions though or along the device.

According to another aspect of the present invention there is provided a method of ion mobility spectrometry or ion mobility separation comprising:

providing a device comprising one or more layers of intermediate planar, plate or mesh electrodes arranged generally or substantially in the plane in which ions travel;

providing a first array of first electrodes disposed on a first side of the one or more layers of intermediate planar, plate or mesh electrodes; and applying one or more voltages or one or more voltage waveforms to the first array of first electrodes in order to urge, propel, force or accelerate at least some ions through and/or along at least a portion of the device.

The method preferably further comprises passing or transmitting ions into the device and allowing the ions to become temporally separated on the basis of their mass, mass to charge ratio or other physico-chemical property.

According to another aspect of the present invention there is provided a method of colliding, fragmenting or reacting ions comprising:

providing a device comprising one or more layers of intermediate planar, plate or mesh electrodes arranged generally or substantially in the plane in which ions travel;

providing a first array of first electrodes disposed on a first side of the one or more layers of intermediate planar, plate or mesh electrodes; and applying one or more voltages or one or more voltage waveforms to the first array of first electrodes in order to urge, propel, force or accelerate at least some ions through and/or along at least a portion of the device.

The method preferably further comprises passing or transmitting ions into the device and allowing or arranging for the ions collide, fragment or react preferably with gas molecules present in the device.

According to another aspect of the present invention there is provided a method of mass spectrometry comprising one or more of the methods as discussed above.

According to an aspect of the present invention there is provided a method of manufacturing or making a device comprising:

interspersing or interleaving one or more layers of intermediate planar, plate or mesh electrodes with a plurality of insulators to form a device having a plurality of planar, plate or mesh electrodes arranged on the insulators to form a stack of electrodes, wherein the electrodes are arranged generally or substantially in a plane of ion travel; and arranging a first array of first electrodes on a first side of the one or more layers of intermediate planar, plate or mesh electrodes.

The method of manufacturing or making a device preferably further comprises arranging a second array of second electrodes on a second side of the one or more layers of intermediate planar, plate or mesh electrodes. The second side is preferably opposed to the first side.

The first array of first electrodes preferably comprises at least 2, 3, 4, 5, 6, 7, 8, 9, 10, 11, 12, 13, 14, 15, 16, 17, 18, 19, 20 or more than 20 electrodes. The second array of second electrodes preferably comprises at least 2, 3, 4, 5, 6, 7, 8, 9, 10, 11, 12, 13, 14, 15, 16, 17, 18, 19, 20 or more than 20 electrodes.

The device may comprise an ion guide, an ion mobility spectrometer or separator or a collision, fragmentation or reaction device.

According to another aspect of the present invention there is provided a method of manufacturing or making a device comprising:

providing one or more layers of intermediate planar, plate or mesh electrodes wherein the electrodes are arranged generally or substantially in a plane in which ions are transmitted, in use, through the device; and arranging a first array of first electrodes on a first side of the one or more layers of intermediate planar, plate or mesh electrodes.

The preferred embodiment relates to an ion guide comprising a plurality of intermediate plate, planar or mesh electrodes and a plurality or array of upper electrodes and/or a plurality or array of lower electrodes. One or more transient DC voltages or potentials or one or more transient DC voltage or potential waveforms are preferably applied to the upper and/or lower electrodes so as to urge, propel, force or accelerate ions along and through the preferred ion guide.

The preferred embodiment enables a plurality of complex ion guide geometries or designs to be provided and enables the motion of ions through the ion guide to be effectively controlled. The transit times of ions through an ion guide according to the preferred embodiment may be significantly improved compared with conventional ion guides.

BRIEF DESCRIPTION OF THE DRAWINGS

Various embodiments of the present invention together with an arrangement given for illustrative purposes only will now be described, by way of example only, and with reference to the accompanying drawings in which.

DETAILED DESCRIPTION OF THE PREFERRED EMBODIMENTS

Figure 1:
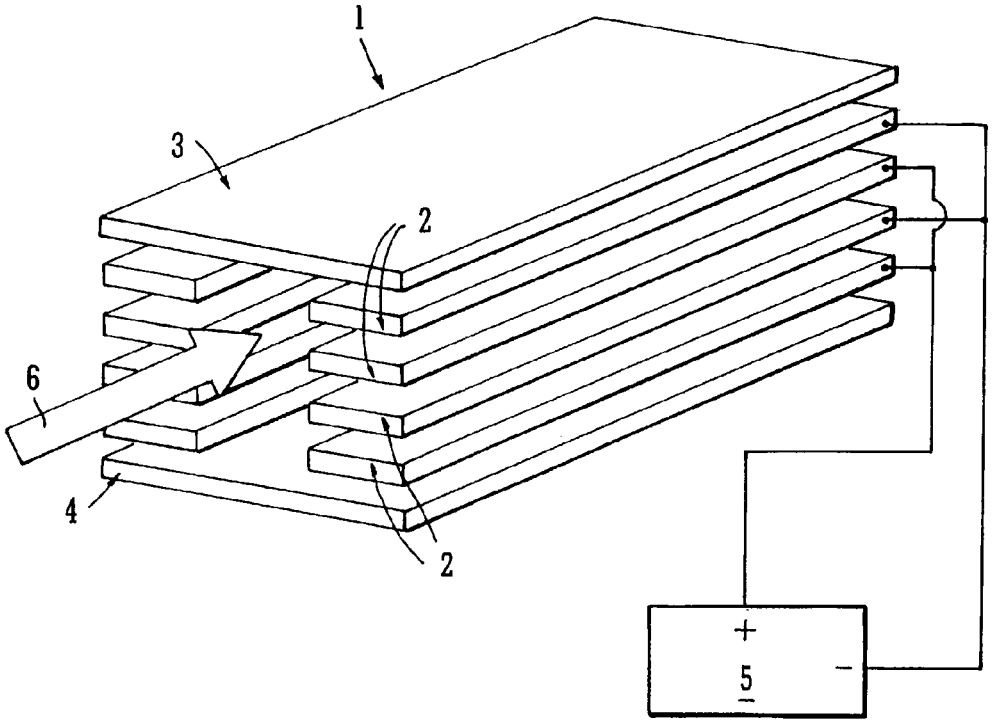
FIG. 1 PRIOR ART
FIG. 1 shows a known ion guide comprising a plurality of layers of intermediate planar electrodes and a single planar upper electrode and a single planar lower electrode.

A known ion guide 1 comprising a stack or plurality of layers of intermediate planar electrodes 2 is shown in FIG. 1. Each layer of intermediate electrodes 2 comprises a first longitudinal electrode and a second longitudinal electrode. The longitudinal electrodes in each layer of intermediate planar electrodes 2 are all arranged substantially in the plane in which ions are transmitted in use through the ion guide 1. The particular ion guide shown in FIG. 1 comprises four layers of intermediate planar electrodes, a single upper planar electrode 3 and a single lower planar electrode 4.

The first longitudinal electrode and the second longitudinal electrode are arranged in the same plane and are arranged to have the same phase of a two-phase AC or RF voltage supply 5 applied to them. Opposite phases of a two-phase AC or RF voltage supply 5 are applied to the adjacent or neighbouring vertical layers of intermediate planar electrodes 2.

The single upper planar electrode 3 and the single lower planar electrode 4 may be supplied with a DC voltage only, an RF voltage only, or a combination of both DC and AC or RF voltages. The voltage(s) applied to the single upper planar electrode 3 and the single lower planar electrode 4 act to cause ions to be confined in the vertical radial direction within the ion guide 1. The voltage(s) applied to the single upper planar electrode 3 and the single lower planar electrode 4 merely confine ions within the ion guide 1 and do not drive or propel ions through the ion guide 1. The AC or RF voltage applied to the longitudinal electrodes in each layer of intermediate planar electrodes 2 generates a pseudo-potential well or barrier which acts to confine ions in the horizontal radial direction within the ion guide 1.

The geometry of the ion guide 1 provides an ion confining volume between the first and second longitudinal electrodes of each layer of intermediate planar electrodes 2 and between the upper and lower single planar electrodes 3,4. Ions can be efficiently transported through the ion confining volume especially when the gas pressure within the ion guide 1 is relatively low. However, if the known ion guide 1 is operated at a relatively high pressure then the kinetic energy of ions passing through the ion guide may be reduced due to collisions between the ions and gas molecules present in the ion guide 1. This will increase the transit time of ions through the known ion guide 1.

An increased ion transit time may be problematic for certain applications particularly when it is desired to scan or switch a component of a mass spectrometer such as an ion gate, a mass filter or mass analyser or a collision cell arranged downstream of the ion guide 1 relatively quickly.

Figure 2:
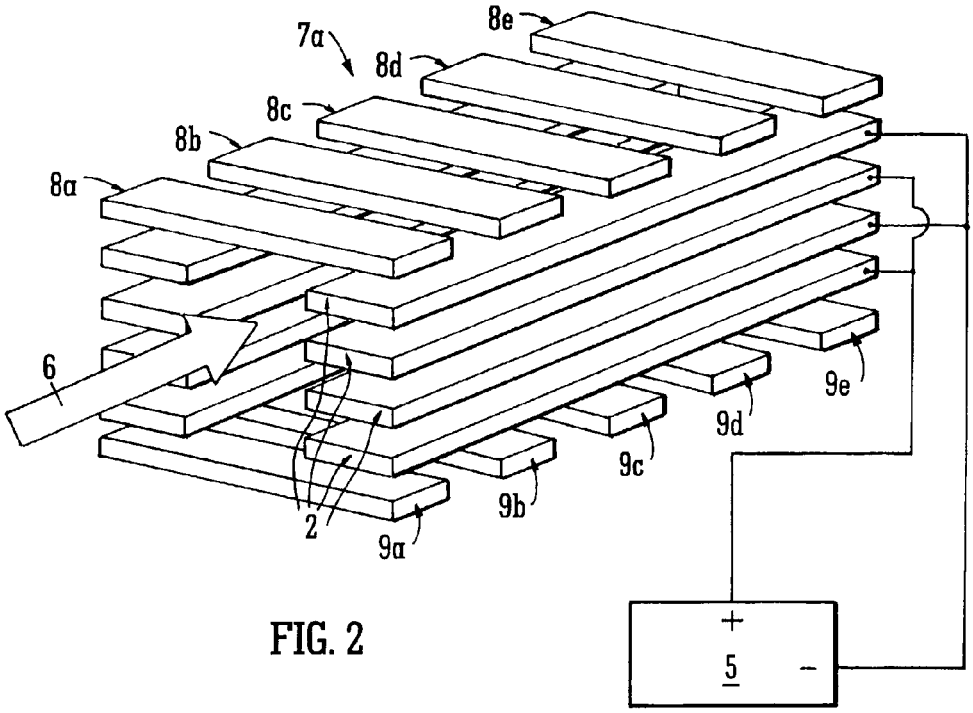
FIG. 2 shows an ion guide according to a preferred embodiment of the present invention comprising a plurality of layers of intermediate planar, plate or mesh electrodes arranged generally in the plane of ion travel and an array of upper and lower electrodes to which one or more transient DC voltages or potentials are preferably applied.

An ion guide 7*a* according to a preferred embodiment of the present invention is shown in FIG. 2. The preferred ion guide 7*a* comprises a plurality or stack of layers of intermediate planar, plate or mesh electrode 2. Each layer of intermediate planar, plate or mesh electrodes 2 preferably comprises a first longitudinal electrode and a second longitudinal electrode. According to other embodiments each layer of intermediate planar, plate or mesh electrodes 2 may comprise more than two longitudinal electrodes.

Each layer of intermediate planar, plate or mesh electrodes 2 are preferably arranged generally or substantially in the plane in which ions are transmitted, in use, through the preferred ion guide 7*a*.

According to the preferred embodiment the ion guide 7*a* preferably comprises an array or a plurality of upper electrodes 8*a*-8*e*. A DC and/or AC or RF voltage is preferably applied to the array or plurality of upper electrodes in order to confine ions within the preferred ion guide 7*a* and hence to provide an upper boundary or ion confinement region to the preferred ion guide 7*a*. Similarly, the ion guide 7*a* preferably comprises an array or a plurality of lower electrodes 9*a*-9*e*. A DC and/or AC or RF voltage is preferably applied to the array or plurality of lower electrodes in order to confine ions within the preferred ion guide 7*a* and hence to provide an lower boundary or ion confinement region to the preferred ion guide 7*a*.

The first longitudinal electrode and the second longitudinal electrode of each layer of intermediate planar, plate or mesh electrodes 2 are preferably arranged in the same plane and are preferably arranged to have the same phase of a two-phase AC or RF voltage 5 applied to them. Opposite phases of a two-phase AC or RF voltage supply 5 are preferably applied to adjacent vertical or neighbouring layers of intermediate planar, plate or mesh electrodes 2.

Four layers of intermediate planar, plate or mesh electrodes are shown in FIG. 2 each having a first longitudinal electrode and a second longitudinal electrode. According to an embodiment the preferred ion guide 7*a* may comprise one, two or three layers of intermediate planar, plate or mesh electrodes. According to another embodiment the preferred ion guide 7*a* may comprise 5, 6, 7, 8, 9, 10, 11, 12, 13, 14, 15, 16, 17, 18, 19, 20 or more than 20 separate layers of intermediate planar, plate or mesh electrodes 2.

The plurality or array of upper electrodes 8*a*-8*e* and the plurality or array of lower electrodes 9*a*-9*e* may be supplied with either a DC voltage only, an AC or RF voltage only, or a combination of both DC and AC or RF voltages in order to confine ions within the preferred ion guide 7*a*.

The AC or RF voltage which is preferably applied to the layers of intermediate planar, plate or mesh electrodes 2 preferably causes an effective pseudo-potential barrier or potential well to be generated which preferably acts to prevent ions moving towards either of the two longitudinal electrodes which comprise each layer of intermediate planar, plate or mesh electrodes 2. Ions are therefore preferably prevented from moving in a horizontal radial direction towards the first and second longitudinal electrodes of each layer of intermediate planar, plate or mesh electrodes 2. Ions are preferably confined in the vertical radial direction by the DC and/or AC or RF voltage which is preferably applied to the plurality or array of upper electrodes 8*a*-8*e* and/or to the plurality or array of lower electrodes 9*a*-9*e*.

The geometry of the preferred ion guide 7*a* preferably provides an ion guiding volume between the first and second longitudinal electrodes of each of the layers of intermediate planar, plate or mesh electrodes 2 and between the plurality or array of upper electrodes 8*a*-8*e* and the plurality or array of lower electrodes 9*a*-9*e*. Ions can preferably be efficiently transported along the ion guiding volume and ions are preferably confined radially within the preferred ion guide 7*a*.

The preferred ion guide 7*a* may be maintained at a gas pressure of between $10^{-4}$-10 mbar or more preferably at a gas pressure between $10^{-3}$ and 1 mbar.

The plurality of upper electrodes 8*a*-8*e* and/or the plurality of lower electrodes 9*a*-9*e* preferably comprise or form a set or an array of electrodes which are preferably electrically isolated from one another. The plurality of upper electrodes 8*a*-8*g* are preferably all arranged in substantially the same plane and the plurality of lower electrodes 9*a*-9*g* are preferably all arranged in substantially the same plane. However, according to less preferred embodiments some of the upper electrodes 8*a*-8*e* may be arranged such that they are not all substantially co-planar. Similarly, according to a less preferred embodiment some of the plurality of lower electrodes 9*a*-9*e* may be arranged so that they are not all substantially co-planar.

According to an embodiment the plurality of upper electrodes 8*a*-8*e* and/or the plurality of lower electrodes 9*a*-9*e* may be arranged in a mode of operation such that they are maintained in use at substantially the same DC potential or voltage and/or that substantially the same AC or RF voltage is applied to the electrodes. According to this embodiment opposite phases of a two-phase AC or RF voltage 5 are preferably applied to adjacent layers of intermediate planar, plate or mesh electrodes 2 preferably in a substantially similar manner to the known ion guide 1.

It will be apparent that according to this embodiment where no transient DC voltage or potential is additionally applied to either the plurality of upper electrodes 8*a*-8*e* or to the plurality of lower electrodes 9*a*-9*e* then the ion guide 7*a* will act in a substantially similar manner to that of the known ion guide 1 as described above with reference to FIG. 1 i.e. ions will not be actively propelled or urged through or along the ion guide 7*a*.

According to a particularly preferred embodiment the preferred ion guide 7*a* may preferably be operated in a mode of operation wherein one or more transient DC voltages or potentials or one or more transient DC voltage or potential waveforms are preferably additionally applied or are additionally superimposed to either the plurality of upper electrodes 8*a*-8*e* and/or to the plurality of lower electrodes 9*a*-9*e*. As a result one or more axial potential barriers or one or more axial potential wells are preferably created within the ion guiding region of the preferred ion guide 7. The ion guiding region is preferably defined by the region below the plurality of upper electrodes 8*a*-8*e*, the region between the longitudinal electrodes in the layers of intermediate planar, plate or mesh electrodes 2 and the region above the plurality of lower electrodes 9*a*-9*e*.

The one or more axial potential wells or barriers which are preferably created within the ion guiding region are preferably progressively translated or moved along at least part of the axial length of the preferred ion guide 7*a*. As a result, ions are preferably driven, propelled or urged along and through at least a portion of the preferred ion guide 7*a*.

According to an alternative embodiment, one or more constant DC voltages or potentials may be applied to the plurality of upper electrodes 8*a*-8*e* and/or the plurality of lower electrodes 9*a*-9*e*. For example, a non-zero linear DC voltage gradient may be maintained along at least a portion of the axial length of the preferred ion guide 7*a*. The constant axial DC voltage gradient may assist in urging or accelerating ions along or through at least a portion of the preferred ion guide 7*a*.

According to another embodiment two or more phase-shifted AC or RF voltages may be applied to the plurality of upper electrodes 8*a*-8*e* and/or to the plurality of lower electrodes 9*a*-9*e* in order to urge, propel, force or accelerate ions along and through at least a portion of the axial length of the preferred ion guide 7*a*.

According to a less preferred unillustrated embodiment, an ion guide according to an embodiment of the present invention may be provided comprising a plurality of upper electrodes, one or more layers of intermediate planar, plate or mesh electrodes and a single planar lower electrode. Alternatively, according to another less preferred unillustrated embodiment an ion guide according to an embodiment of the present invention may be provided comprising a plurality of lower electrodes, one or more layers of intermediate planar, plate or mesh electrodes and a single planar upper electrode. According to such less preferred embodiments, an ion guide may be provided which comprises one or more layers of intermediate electrodes, a plurality of electrodes or an array of electrodes forming an upper (or a lower) boundary and a single planar, plate or mesh electrode forming a corresponding lower (or upper) boundary.

Figure 3:
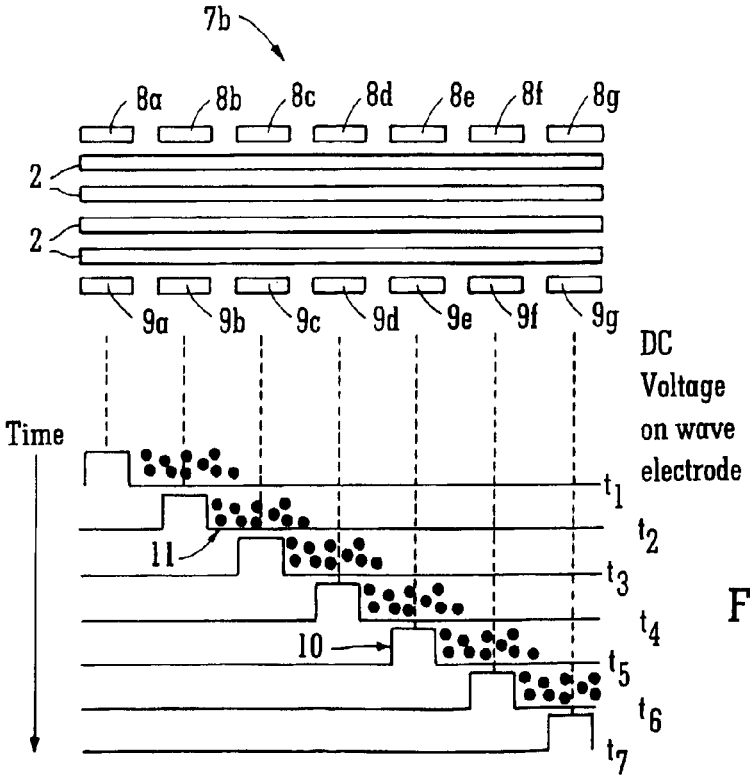
FIG. 3 shows a side view of a preferred ion guide and illustrates ions being propelled or urged through the preferred ion guide by a transient DC voltage or potential being progressively applied to successive electrodes of the upper array of electrodes and the lower array of electrodes.

FIG. 3 illustrates an embodiment of the present invention wherein the preferred ion guide 7*b* comprises four layers of intermediate planar, plate or mesh electrodes 2. The plurality or array of upper electrodes 8*a*-8*g* and the plurality or array of lower electrodes 9*a*-9*g* each comprise seven separate or discrete electrodes. The potential of each electrode in the array of upper and lower electrodes 8*a*-8*g*, 9*a*-9*g* may be independently controllable.

According to the preferred embodiment the number of upper electrodes is preferably the same as the number of lower electrodes. However, according to less preferred embodiments the upper electrodes may be arranged differently and/or may have different dimensions to those of the lower electrodes. For example, the spacing between the upper electrodes may be different to the spacing between the lower electrodes. It is therefore contemplated that according to less preferred embodiments the number of electrodes in the upper array of electrodes may differ from the number of electrodes in the lower array of electrodes.

FIG. 3 also shows how according to an embodiment of the present invention one or more transient DC voltages or potentials or one or more transient DC voltage or potential waveforms 10 may be progressively or sequentially applied to the upper electrodes 8*a*-8*g* and/or the lower electrodes 9*a*-9*g* of the ion guide 7*b*. FIG. 3 shows how at a first time $t_1$ a transient DC voltage or potential is preferably applied to the first electrode 8*a*,9*a* of the array of upper and lower electrodes 8*a*-8*g*,9*a*-9*g*. At a second later time $t_2$ a transient DC voltage or potential is preferably then applied to the second electrode 8*b*, 9*b* of the array of upper and lower electrodes 8*a*-8*g*, 9*a*-9*g*. At a yet later third time $t_3$ a transient DC voltage or potential is preferably applied to the third electrodes 8*c*,9*c* of the array of upper and lower electrodes 8*a*-8*g*,9*a*-9*g*. At yet later fourth, fifth, sixth and seventh times $t_4$, $t_5$, $t_6$ and $t_7$ a transient DC voltage or potential is preferably applied to the fourth 8*d*,9*d*, fifth 8*e*,9*e*, sixth 8*f*,9*f* and seventh 8*g*,9*g* electrodes of the array of upper and lower electrodes 8*a*-8*g*,9*a*-9*g*.

As the transient DC voltage or potential 10 is progressively or successively applied to the array of upper electrodes 8*a*-8*g* and/or to the array of lower electrodes 9*a*-9*g*, ions 11 are preferably urged along in front of a travelling potential barrier 10 which is preferably created within the preferred ion guide 7*b*. The ions 11 are therefore preferably propelled or urged along the length of the preferred ion guide 7*b* ahead of the potential barrier 10 which is preferably translated along the length of the ion guide 7*b*.

By progressively or sequentially applying one or more transient DC voltages or potentials or one or more transient DC voltage or potential waveforms 10 to the arrays of upper electrodes 8*a*-8*g* and/or lower electrodes 9*a*-9*g* a moving axial potential barrier or potential well is preferably created which is preferably progressively translated along the length of the preferred ion guide 7*a*,7*b*. The potential barrier or potential well which is preferably translated along the length of the preferred ion guide 7*a*,7*b* preferably causes some or substantially all of the ions 11 to be driven or propelled through the preferred ion guide 7*a*,7*b* preferably against background gas which may be present in the preferred ion guide 7*a*,7*b*. The one or more transient DC voltages or potentials or one or more transient DC voltage or potential waveforms which are preferably applied to the arrays of upper electrodes 8*a*-8*g* and/or to the lower electrodes 9*a*-9*g* preferably has the advantageous effect of reducing the ion transit time through the preferred ion guide 7*a*,7*b*.

Figure 4:
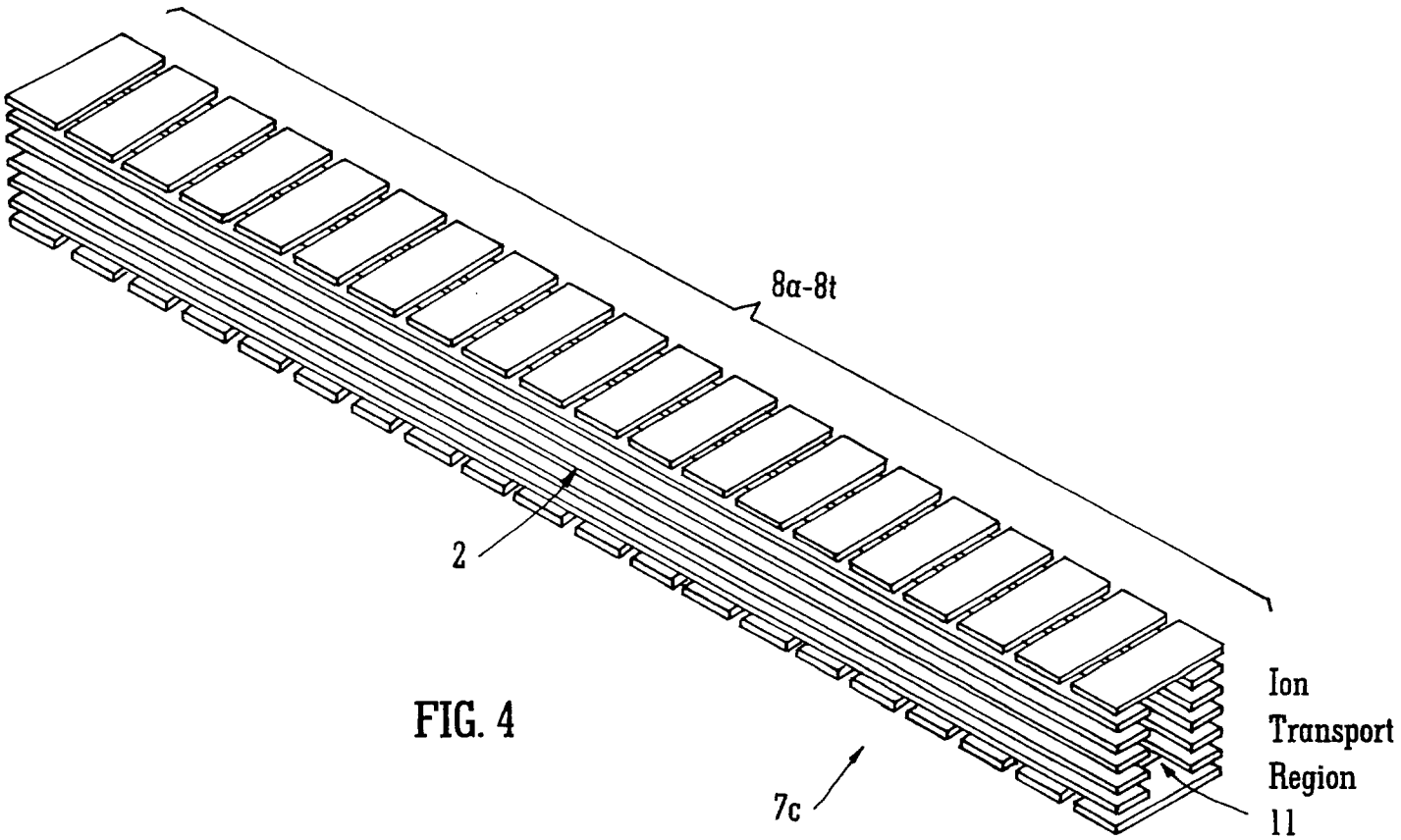
FIG. 4 shows the geometry of a preferred ion guide which was used to model various ion trajectories.

A simulation of an ion transiting through a preferred ion guide 7*c* as shown in FIG. 4 was modelled using the ion optics package SIMION v7.0®. The ion guide 7*c* was modelled as comprising five layers of intermediate planar electrodes 2. Each layer of intermediate planar electrodes 2 comprised a first longitudinal electrode and a second longitudinal electrode. Each longitudinal electrode was 0.6 mm thick, 2.4 mm wide and 97 mm long. The longitudinal electrodes were modelled as being arranged one above another with a vertical centre-to-centre spacing of 1.6 mm. The first and second longitudinal electrodes of each layer were arranged to separated horizontally from one another by 5 mm. A two-phase AC or RF voltage was modelled as being applied to the layers of intermediate planar electrodes 2 with both longitudinal electrodes in each layer 2 being connected to the same phase of the AC or RF voltage. Vertically adjacent layers of intermediate planar electrodes 2 were arranged to be connected to opposite phases of the AC or RF voltage.

An array of twenty upper electrodes 8*a*-8*t* and an array of twenty lower electrodes 9*a*-9*t* was modelled as being provided. Each electrode in the array of upper and lower electrodes 8*a*-8*t*,9*a*-9*t* was modelled as being 0.6 mm thick, 4 mm long (in the axial direction) and 9.8 mm wide. The face to face spacing of each electrode in the array of upper electrodes 8*a*-8*t* to corresponding electrodes in the array of lower electrodes 9*a*-9*t* was modelled as being 9 mm.

Figure 5:
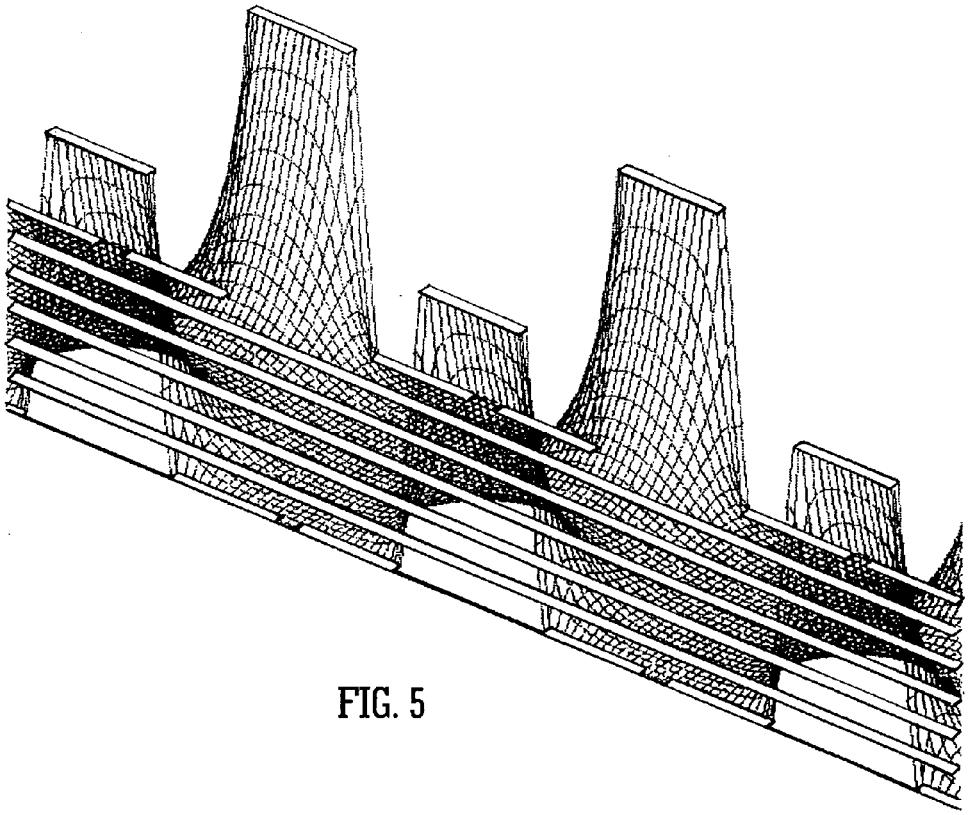
FIG. 5 shows an electric potential surface created by applying +10 V to every third electrode of the electrodes in the array of upper electrodes and the array of lower electrodes whilst the other electrodes in the array of upper electrodes and the array of lower electrodes were maintained at 0V and whilst the plurality of layers of intermediate planar electrodes were also maintained at 0V.

FIG. 5 illustrates a potential surface resulting from applying 10V DC to every third electrode of the array of upper electrodes 8*a*-8*t* and by applying 10V DC to every third electrode of the array of lower electrodes 9*a*-9*t*. A user program was written for the SIMION® package to enable simulation of collisions between an ion modelled as being present within the ion guide 7*c* and a neutral gas.

Figure 6A:
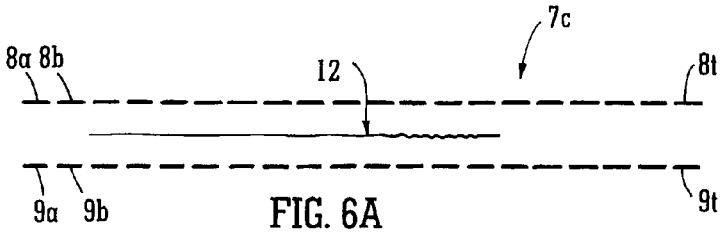
FIG. 6A shows the trajectory of an ion through a preferred ion guide in a mode of operation wherein no transient DC voltage or potential was applied to the upper array of electrodes and no transient DC voltage or potential was applied to the lower array of electrodes and FIG. 6B shows the trajectory of an ion according to the preferred embodiment when a transient DC voltage or potential was progressively applied to the electrodes of the upper array of electrodes and to the electrodes of the lower array of electrodes.

FIG. 6A shows the trajectory 12 of an ion having an energy of 3 eV in an ion guide 7*c* according to a preferred embodiment but wherein no transient DC voltage or potential was modelled as being applied to either the array of upper electrodes 8*a*-8*t* or to the array of lower electrodes 9*a*-9*t*. An RF voltage having a frequency of 1 MHz and a peak-to-peak amplitude of 200 V was modelled as being applied to the electrodes in the five layers of intermediate planar electrodes 2 in order to confine ions in the horizontal radial direction.

A constant DC offset of +2 V was simulated as being maintained between the array of upper electrodes 8*a*-8*t* and the layers of intermediate planar electrodes 2. Similarly, a constant DC offset of +2V was also simulated as being maintained between the array of lower electrodes 9*a*-9*t* relative to layers of intermediate planar electrodes 2. The constant DC offset between the array of upper electrodes 8*a*-8*t* and the array of lower electrodes 9*a*-9*t* relative to the layers of intermediate planar electrodes 2 ensured that ions were confined within the preferred ion guide 7 in the vertical radial direction.

The gas pressure within the ion guide 7*c* was simulated as being $1\times10^{-2}$ mbar. After multiple collisions with the neutral gas molecules the ion was observed to lose axial kinetic velocity to such an extent that the ion did not exit the preferred ion guide 7.

Figure 6B:
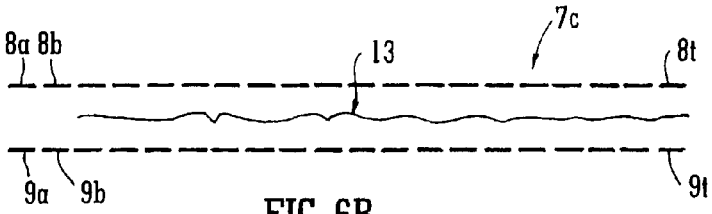

FIG. 6B shows the trajectory 13 of an ion having an energy of 3 eV in a preferred ion guide 7*c* wherein a transient DC voltage or potential having an amplitude 10 V was modelled as being progressively applied to the electrodes in the arrays of upper and lower electrodes 8*a*-8*t*,9*a*-9*t*. The transient DC voltage or potential was applied to each electrode for a period of 20 μs before being applied to the next or successive electrode along the length of the ion guide 7*c*.

According to this embodiment the ion 13 was observed to be efficiently propelled through the preferred ion guide 7*c* by an axial potential barrier which was preferably progressively translated along the axial length of the preferred ion guide 7*c*. It is apparent therefore, that from the model the application of a transient DC voltage or potential to the arrays of upper and lower electrodes 8*a*-8*t*,9*a*-9*t* had the effect of significantly improving the transit time through the preferred ion guide 7*c*.

Although the preferred ion guide has been described as comprising a linear ion guiding region other embodiments are contemplated wherein the ion transport volume may have a convoluted or substantially curved or irregular path. Such embodiments may be particularly advantageous in certain circumstances.

According to an embodiment the array of upper electrodes and/or the array of lower electrodes may be mounted on one or more printed circuit boards. Such an embodiment has the advantage of simplifying the connections and interconnections of the upper electrodes and the lower electrodes.

An ion guide 7*a*,7*b*,7*c* according to the preferred embodiment may be used to effect the rapid transport of ions through a gas. An alternative embodiment of the present invention is contemplated wherein a device substantially similar to the preferred ion guide 7*a*,7*b*,7*c* may be provided but wherein the device may be used as an ion mobility spectrometer or separator.

When the device is used as an ion mobility spectrometer or separator the height, amplitude or depth of the one or more DC voltage or potential barriers, hills or wells created within the device may be preferably set to a relatively low level such that at least some ions present within the device will slip or otherwise pass over the potential barrier or hill as it is preferably being translated along the length of the device. As a result, ions having a relatively high ion mobility will tend to slip over or otherwise pass over the potential barrier or hill as it passes along whereas ions having a relatively low ion mobility will tend to be urged forwards by the potential barrier or hill. Accordingly, ions will become temporally separated on the basis of or according to their ion mobility. By using elevated gas pressures and/or higher wave velocities, ion mobility separation of an ion mixture can therefore be achieved.

A yet further alternative embodiment of the present invention is contemplated wherein a device substantially similar to the preferred ion guide 7*a*,7*b*,7*c* may be provided but wherein the device may be used as a collision, fragmentation or reaction device.

According to this embodiment ions may be transported through the device or may be transported into the device with sufficient kinetic energy or velocity such that the ions are preferably caused to collide with background gas molecules present in the device thereby causing or otherwise inducing the ions to fragment into fragment or daughter ions. The device may accordingly be used as a collision or fragmentation cell preferably as part of a tandem mass spectrometer. The tandem mass spectrometer may comprise a quadrupole mass filter, a magnetic sector mass analyser, a linear quadrupole ion trap mass analyser, a 3-D quadrupole ion trap mass analyser, an axial Time of Flight mass analyser, an orthogonal acceleration Time of Flight mass analyser, a Fourier Transform ICR mass analyser, or any combination thereof.

According to another embodiment the device may comprise a collision, reaction or fragmentation device wherein the fragmentation or reaction device is selected from the group consisting of: (i) a Surface Induced Dissociation ("SID") fragmentation device; (ii) an Electron Transfer Dissociation fragmentation device; (iii) an Electron Capture Dissociation fragmentation device; (iv) an Electron Collision or Impact Dissociation fragmentation device; (v) a Photo Induced Dissociation ("PID") fragmentation device; (vi) a Laser Induced Dissociation fragmentation device; (vii) an infrared radiation induced dissociation device; (viii) an ultraviolet radiation induced dissociation device; (ix) a nozzle-skimmer interface fragmentation device; (x) an in-source fragmentation device; (xi) an ion-source Collision Induced Dissociation fragmentation device; (xii) a thermal or temperature source fragmentation device; (xiii) an electric field induced fragmentation device; (xiv) a magnetic field induced fragmentation device; (xv) an enzyme digestion or enzyme degradation fragmentation device; (xvi) an ion-ion reaction fragmentation device; (xvii) an ion-molecule reaction fragmentation device; (xviii) an ion-atom reaction fragmentation device; (xix) an ion-metastable ion reaction fragmentation device; (xx) an ion-metastable molecule reaction fragmentation device; (xxi) an ion-metastable atom reaction fragmentation device; (xxii) an ion-ion reaction device for reacting ions to form adduct or product ions; (xxiii) an ion-molecule reaction device for reacting ions to form adduct or product ions; (xxiv) an ion-atom reaction device for reacting ions to form adduct or product ions; (xxv) an ion-metastable ion reaction device for reacting ions to form adduct or product ions; (xxvi) an ion-metastable molecule reaction device for reacting ions to form adduct or product ions; and (xxvii) an ion-metastable atom reaction device for reacting ions to form adduct or product ions.

Further embodiments are contemplated wherein each layer of intermediate planar, plate or mesh electrodes may comprise more than two longitudinal electrodes. For example, embodiments are contemplated wherein each layer of intermediate planar, plate or mesh electrode may comprise 3, 4, 5, 6, 7, 8, 9, 10 or more than 10 longitudinal electrodes.

Although the present invention has been described with reference to the preferred embodiments, it will be understood by those skilled in the art that various changes in form and detail may be made without departing from the scope of the invention as set forth in the accompanying claims.

The invention claimed is:

1. A device comprising:

one or more layers of intermediate planar, plate or mesh electrodes arranged generally or substantially along a longitudinal axis of said device and in a plane in which ions travel in use;

a first array of first electrodes disposed on a first side of said one or more layers of intermediate planar, plate or mesh electrodes; and a voltage source arranged and adapted to progressively or sequentially apply one or more transient DC voltages or one or more transient DC voltage waveforms to said first array of first electrodes in order to urge, propel, force or accelerate ions progressively along at least 60% of the longitudinal axis of said device wherein the ions enter and exit the device along the axis.

2. A device as claimed in claim 1, wherein said first array of first electrodes comprises at least 10 or more electrodes.

3. A device as claimed in claim 1, wherein said first array of first electrodes comprises: (i) a printed circuit board, printed wiring board or etched wiring board; (ii) a plurality of conductive traces applied or laminated onto a non-conductive substrate; (iii) a plurality of copper or metallic electrodes arranged on a substrate; (iv) a screen printed, photoengraved, etched or milled printed circuit board; (v) a plurality of electrodes arranged on a paper substrate impregnated with phenolic resin; (vi) a plurality of electrodes arranged on a fibreglass mat impregnated within an epoxy resin; (vii) a plurality of electrodes arranged on a plastic substrate; or (viii) a plurality of electrodes arranged on a substrate.

4. A device as claimed in claim 1, wherein at least 5%, 10%, 15%, 20%, 25%, 30%, 35%, 40%, 45%, 50%, 55%, 60%, 65%, 70%, 75%, 80%, 85%, 90%, 95% or 100% of said first electrodes have an axial centre to centre spacing selected from the group consisting of: (i) <1 mm; (ii) 1-2 mm; (iii) 2-3 mm; (iv) 3-4 mm; (v) 4-5 mm; (vi) 5-6 mm; (vii) 6-7 mm; (viii) 7-8 mm; (ix) 8-9 mm; (x) 9-10 mm; (xi) 10-11 mm; (xii) 11-12 mm; (xiii) 12-13 mm; (xiv) 13-14 mm; (xv) 14-15 mm; (xvi) 15-16 mm; (xvii) 16-17 mm; (xviii) 17-18 mm; (xix) 18-19 mm; (xx) 19-20 mm; and (xxi) >20 mm.

5. A device as claimed in claim 1, wherein at least 5%, 10%, 15%, 20%, 25%, 30%, 35%, 40%, 45%, 50%, 55%, 60%, 65%, 70%, 75%, 80%, 85%, 90%, 95% or 100% of said first electrodes have an axial length selected from the group consisting of: (i) <1 mm; (ii) 1-2 mm; (iii) 2-3 mm; (iv) 3-4 mm; (v) 4-5 mm; (vi) 5-6 mm; (vii) 6-7 mm; (viii) 7-8 mm; (ix) 8-9 mm; (x) 9-10 mm; (xi) 10-11 mm; (xii) 11-12 mm; (xiii) 12-13 mm; (xiv) 13-14 mm; (xv) 14-15 mm; (xvi) 15-16 mm; (xvii) 16-17 mm; (xviii) 17-18 mm; (xix) 18-19 mm; (xx) 19-20 mm; and (xxi) >20 mm.

6. A device as claimed in claim 1, wherein at least 5%, 10%, 15%, 20%, 25%, 30%, 35%, 40%, 45%, 50%, 55%, 60%, 65%, 70%, 75%, 80%, 85%, 90%, 95% or 100% of said first electrodes have a width selected from the group consisting of: (i) <1 mm; (ii) 1-2 mm; (iii) 2-3 mm; (iv) 3-4 mm; (v) 4-5 mm; (vi) 5-6 mm; (vii) 6-7 mm; (viii) 7-8 mm; (ix) 8-9 mm; (x) 9-10 mm; (xi) 10-11 mm; (xii) 11-12 mm; (xiii) 12-13 mm; (xiv) 13-14 mm; (xv) 14-15 mm; (xvi) 15-16 mm; (xvii) 16-17 mm; (xviii) 17-18 mm; (xix) 18-19 mm; (xx) 19-20 mm; and (xxi) >20 mm.

7. A device as claimed in claim 1, wherein the first electrodes have a thickness selected from the group consisting of: (i) <0.01 mm; (ii) 0.01-0.1 mm; (iii) 0.1-0.2 mm; (iv) 0.2-0.3 mm; (v) 0.3-0.4 mm; (vi) 0.4-0.5 mm; (vii) 0.5-0.6 mm; (viii) 0.6-0.7 mm; (ix) 0.7-0.8 mm; (x) 0.8-0.9 mm; (xi) 0.9-1.0 mm; (xii) 1-2 mm; (xiii) 2-3 mm; (xiv) 3-4 mm; (xv) 4-5 mm; and (xvi) >5 mm.

8. A device as claimed in claim 1, wherein at least 5%, 10%, 15%, 20%, 25%, 30%, 35%, 40%, 45%, 50%, 55%, 60%, 65%, 70%, 75%, 80%, 85%, 90%, 95% or 100% of said first electrodes are biased, in use, at a first bias DC voltage or potential with respect to the mean or average voltage or potential of at least some or all of said intermediate planar, plate or mesh electrodes, and wherein said first DC bias voltage or potential is selected from the group consisting of: (i) less than −10V; (ii) −9 to −8V; (iii) −8 to −7V; (iv) −7 to −6V; (v) −6 to −5V; (vi) −5 to −4V; (vii) −4 to −3V; (viii) −3 to −2V; (ix) −2 to −1V; (x) −1 to 0V; (xi) 0 to 1V; (xii) 1 to 2V; (xiii) 2 to 3V; (xiv) 3 to 4V; (xv) 4 to 5V; (xvi) 5 to 6V; (xvii) 6 to 7V; (xviii) 7 to 8V; (xix) 8 to 9V; (xx) 9 to 10V; and (xxi) more than 10V.

9. A device as claimed in claim 1, further comprising a second array of second electrodes disposed on a second different or opposed side of said one or more layers of intermediate planar, plate or mesh electrodes to said first array of first electrodes.

10. A device as claimed in claim 9, wherein said voltage source is arranged and adapted to apply one or more voltages or one or more voltage waveforms to said second array of second electrodes in order to urge, propel, force or accelerate at least some ions through or along at least a portion of said device.

11. A device as claimed in claim 9, wherein said second array of second electrodes comprises at least 2, 3, 4, 5, 6, 7, 8, 9, 10, 11, 12, 13, 14, 15, 16, 17, 18, 19, 20 or more than 20 electrodes.

12. A device as claimed in claim 9, wherein said second array of second electrodes comprises: (i) a printed circuit board, printed wiring board or etched wiring board; (ii) a plurality of conductive traces applied or laminated onto a non-conductive substrate; (iii) a plurality of copper or metallic electrodes arranged on a substrate; (iv) a screen printed, photoengraved, etched or milled printed circuit board; (v) a plurality of electrodes arranged on a paper substrate impregnated with phenolic resin; (vi) a plurality of electrodes arranged on a fiberglass mat impregnated within an epoxy resin; (vii) a plurality of electrodes arranged on a plastic substrate; or (viii) a plurality of electrodes arranged on a substrate.

13. A device as claimed in claim 9, wherein at least 5%, 10%, 15%, 20%, 25%, 30%, 35%, 40%, 45%, 50%, 55%, 60%, 65%, 70%, 75%, 80%, 85%, 90%, 95% or 100% of said second electrodes have an axial centre to centre spacing selected from the group consisting of: (i) <1 mm; (ii) 1-2 mm; (iii) 2-3 mm; (iv) 3-4 mm; (v) 4-5 mm; (vi) 5-6 mm; (vii) 6-7 mm; (viii) 7-8 mm; (ix) 8-9 mm; (x) 9-10 mm; (xi) 10-11 mm; (xii) 11-12 mm; (xiii) 12-13 mm; (xiv) 13-14 mm; (xv) 14-15 mm; (xvi) 15-16 mm; (xvii) 16-17 mm; (xviii) 17-18 mm; (xix) 18-19 mm; (xx) 19-20 mm; and (xxi) >20 mm.

14. A device as claimed in claim 9, wherein at least 5%, 10%, 15%, 20%, 25%, 30%, 35%, 40%, 45%, 50%, 55%, 60%, 65%, 70%, 75%, 80%, 85%, 90%, 95% or 100% of said second electrodes have an axial length selected from the group consisting of: (i) <1 mm; (ii) 1-2 mm; (iii) 2-3 mm; (iv) 3-4 mm; (v) 4-5 mm; (vi) 5-6 mm; (vii) 6-7 mm; (viii) 7-8 mm; (ix) 8-9 mm; (x) 9-10 mm; (xi) 10-11 mm; (xii) 11-12 mm; (xiii) 12-13 mm; (xiv) 13-14 mm; (xv) 14-15 mm; (xvi) 15-16 mm; (xvii) 16-17 mm; (xviii) 17-18 mm; (xix) 18-19 mm; (xx) 19-20 mm; and (xxi) >20 mm.

15. A device as claimed in claim 9, wherein at least 5%, 10%, 15%, 20%, 25%, 30%, 35%, 40%, 45%, 50%, 55%, 60%, 65%, 70%, 75%, 80%, 85%, 90%, 95% or 100% of said second electrodes have a width selected from the group consisting of: (i) <1 mm; (ii) 1-2 mm; (iii) 2-3 mm; (iv) 3-4 mm; (v) 4-5 mm; (vi) 5-6 mm; (vii) 6-7 mm; (viii) 7-8 mm; (ix) 8-9 mm; (x) 9-10 mm; (xi) 10-11 mm; (xii) 11-12 mm; (xiii) 12-13 mm; (xiv) 13-14 mm; (xv) 14-15 mm; (xvi)

15-16 mm; (xvii) 16-17 mm; (xviii) 17-18 mm; (xix) 18-19 mm; (xx) 19-20 mm; and (xxi) >20 mm.

16. A device as claimed in claim 9, wherein the second electrodes have a thickness selected from the group consisting of: (i) <0.01 mm; (ii) 0.01-0.1 mm; (iii) 0.1-0.2 mm; (iv) 0.2-0.3 mm; (v) 0.3-0.4 mm; (vi) 0.4-0.5 mm; (vii) 0.5-0.6 mm; (viii) 0.6-0.7 mm; (ix) 0.7-0.8 mm; (x) 0.8-0.9 mm; (xi) 0.9-1.0 mm; (xii) 1-2 mm; (xiii) 2-3 mm; (xiv) 3-4 mm; (xv) 4-5 mm; and (xvi) >5 mm.

17. A device as claimed in claim 9, wherein at least 5%, 10%, 15%, 20%, 25%, 30%, 35%, 40%, 45%, 50%, 55%, 60%, 65%, 70%, 75%, 80%, 85%, 90%, 95% or 100% of said second electrodes are biased, in use, at a second bias DC voltage or potential with respect to the mean or average voltage or potential of at least some or all of said planar, plate or mesh electrodes, and wherein said second DC bias voltage or potential is selected from the group consisting of: (i) less than −10V; (ii) −9 to −8V; (iii) −8 to −7V; (iv) −7 to −6V; (v) −6 to −5V; (vi) −5 to −4V; (vii) −4 to −3V; (viii) −3 to −2V; (ix) −2 to −1V; (x) −1 to 0V; (xi) 0 to 1V; (xii) 1 to 2V; (xiii) 2 to 3V; (xiv) 3 to 4V; (xv) 4 to 5V; (xvi) 5 to 6V; (xvii) 6 to 7V; (xviii) 7 to 8V; (xix) 8 to 9V; (xx) 9 to 10V; and (xxi) more than 10V.

18. A device as claimed in claim 9, wherein said second array of second electrodes are supplied in a mode of operation with:

(i) a DC only voltage; or (ii) a DC and an AC or RF voltage.

19. A device as claimed in claim 9, wherein said voltage source is arranged and adapted to apply one or more transient DC voltages or potentials or one or more transient DC voltage or potential waveforms to said second array of second electrodes in order to urge, propel, force or accelerate at least some ions through or along at least a portion or at least 5%, 10%, 15%, 20%, 25%, 30%, 35%, 40%, 45%, 50%, 55%, 60%, 65%, 70%, 75%, 80%, 85%, 90%, 95% or 100% of said device.

20. A device as claimed in claim 9, wherein said voltage source is arranged and adapted to apply one or more substantially constant DC voltages or potentials to said second array of second electrodes in order to urge, propel, force or accelerate at least some ions through or along at least a portion or at least 5%, 10%, 15%, 20%, 25%, 30%, 35%, 40%, 45%, 50%, 55%, 60%, 65%, 70%, 75%, 80%, 85%, 90%, 95% or 100% of said device.

21. A device as claimed in claim 9, wherein said voltage source is arranged and adapted to apply two or more phase-shifted AC or RF voltages or potentials to said second array of second electrodes in order to urge, propel, force or accelerate at least some ions through or along at least a portion or at least 5%, 10%, 15%, 20%, 25%, 30%, 35%, 40%, 45%, 50%, 55%, 60%, 65%, 70%, 75%, 80%, 85%, 90%, 95% or 100% of said device.

22. A device as claimed in claim 1, further comprising means for maintaining a non-zero DC voltage or potential gradient along at least a portion or at least 5%, 10%, 15%, 20%, 25%, 30%, 35%, 40%, 45%, 50%, 55%, 60%, 65%, 70%, 75%, 80%, 85%, 90%, 95% or 100% of said device, and, wherein said non-zero DC voltage or potential gradient causes ions to be accelerated along at least a portion or at least 5%, 10%, 15%, 20%, 25%, 30%, 35%, 40%, 45%, 50%, 55%, 60%, 65%, 70%, 75%, 80%, 85%, 90%, 95% or 100% of said device.

23. A device as claimed in claim 22, wherein said non-zero DC voltage or potential gradient presents a potential barrier or hill which acts to oppose the onward transmission of ions or which acts to decelerate ions, said non-zero DC voltage or potential gradient being maintained along at least a portion or at least 5%, 10%, 15%, 20%, 25%, 30%, 35%, 40%, 45%, 50%, 55%, 60%, 65%, 70%, 75%, 80%, 85%, 90%, 95% or 100% of said device.

24. A device as claimed in claim 23, wherein said voltage source causes ions to overcome the effects of said non-zero DC voltage or potential gradient so that at least a portion or at least 5%, 10%, 15%, 20%, 25%, 30%, 35%, 40%, 45%, 50%, 55%, 60%, 65%, 70%, 75%, 80%, 85%, 90%, 95% or 100% of ions within said device are onwardly transmitted across or through said non-zero DC voltage or potential gradient.

25. A device as claimed in claim 1, wherein said one or more layers of intermediate planar, plate or mesh electrodes comprises 1, 2, 3, 4, 5, 6, 7, 8, 9, 10, 11, 12, 13, 14, 15, 16, 17, 18, 19, 20 or more than 20 layers of intermediate planar, plate or mesh electrodes.

26. A device as claimed in claim 1, wherein each layer of intermediate planar, plate or mesh electrodes comprises two or more longitudinal electrodes.

27. A device as claimed in claim 26, wherein said two or more longitudinal electrodes are supplied, in use, with substantially the same phase of a two phase or multi-phase AC or RF voltage or signal, and wherein adjacent layers of planar, plate or mesh electrodes are supplied with opposite or different phases of an AC or RF voltage or signal.

28. A device as claimed in claim 27, wherein said AC or RF voltage or signal has a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

29. A device as claimed in claim 27, wherein the amplitude of said AC or RF voltage or signal is selected from the group consisting of: (i) <50V peak to peak; (ii) 50-100V peak to peak; (iii) 100-150V peak to peak; (iv) 150-200V peak to peak; (v) 200-250V peak to peak; (vi) 250-300V peak to peak; (vii) 300-350V peak to peak; (viii) 350-400V peak to peak; (ix) 400-450V peak to peak; (x) 450-500V peak to peak; and (xi) >500V peak to peak.

30. A device as claimed in claim 1, wherein said device has a substantially linear or a substantially curved ion guiding region.

31. A device as claimed in claim 1, wherein said device is maintained, in use, at a pressure selected from the group consisting of: (i) >0.0001 mbar; (ii) >0.001 mbar; (iii) >0.01 mbar; (iv) >0.1 mbar; (v) >1 mbar; (vi) >10 mbar; (vii) >100 mbar; (viii) 0.0001-0.001 mbar; (ix) 0.001-0.01 mbar; (x) 0.01-0.1 mbar; (xi) 0.1-1 mbar; (xii) 1-10 mbar; (xiii) 10-100 mbar; (xiv) 100-1000 mbar; (xv) <0.0001 mbar; (xvi) <0.001 mbar; (xvii) <0.01 mbar; (xviii) <0.1 mbar; (xix) <1 mbar; (xx) <10 mbar; (xxi) 0.0001-100 mbar; (xxii) 0.001-10 mbar; and (xxiii) 0.01-1 mbar.

32. A device as claimed in claim 1, wherein said device comprises:

(i) an ion guide;

(ii) an ion mobility spectrometer or separator; or (iii) a collision, fragmentation or reaction device.

33. A device as claimed in claim 1, further comprising a plurality of insulator layers interspersed or interleaved between said one or more layers of intermediate planar, plate or mesh electrodes.

34. A device as claimed in claim 1, wherein said device is arranged and adapted:

(i) to receive a substantially continuous beam of ions and is arranged and adapted to release or eject ions as a plurality of packets or bunches of ions; or (ii) to convert a substantially continuous beam of ions into a pulsed or discontinuous beam of ions.

35. The device as claimed in claim 1, wherein the voltage source is arranged and adapted to apply a DC or AC voltage to the first array of first electrodes to provide a boundary and to confine the ions within the ion guide such that the ions do not pass through the first array of first electrodes.

36. The device as claimed in claim 1, wherein the voltage source is arranged and adapted to progressively or sequentially apply one or more transient DC voltages or one or more transient DC voltage waveforms to said first array of first electrodes in order to urge, propel, force or accelerate the ions progressively along 100% of the device in the longitudinal direction.

37. A mass spectrometer comprising one or more devices comprising:

one or more layers of intermediate planar, plate or mesh electrodes arranged generally or substantially along a longitudinal axis of each of said one or more devices and in a plane in which ions travel in use;

a first array of first electrodes disposed on a first side of said one or more layers of intermediate planar, plate or mesh electrodes; and a voltage source arranged and adapted to progressively or sequentially apply one or more transient DC voltages or one or more transient DC voltage waveforms to said first array of first electrodes in order to urge, propel, force or accelerate at least some ions progressively along at least 60% of the longitudinal axis of each of said one or more devices so that the ions enter and exit the device along the axis.

38. A mass spectrometer as claimed in claim 37, further comprising an ion source, wherein said ion source is selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; and (xviii) a Thermospray ion source.

39. A mass spectrometer as claimed in claim 37, further comprising a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic or orbitrap mass analyser; (x) a Fourier Transform electrostatic or orbitrap mass analyser; (xi) a Fourier Transform mass analyser; (xii) a Time of Flight mass analyser; (xiii) an axial acceleration Time of Flight mass analyser; and (xiv) an orthogonal acceleration Time of Flight mass analyser.

40. A method of guiding ions with a device comprising one or more layers of intermediate planar, plate or mesh electrodes arranged generally or substantially along a longitudinal axis of said device and in the plane in which ions travel and a first array of first electrodes disposed on a first side of said one or more layers of intermediate planar, plate or mesh electrodes, said method comprising:

progressively or sequentially applying one or more transient DC voltages or one or more transient DC voltage waveforms to said first array of first electrodes in order to urge, propel, force or accelerate at least some ions progressively along at least 60% of the longitudinal axis of said device; and causing the ions enter and exit the device along the axis.

41. A method of guiding ions according to claim 40, further comprising urging the ions along one of the intermediate planar, plate or mesh electrodes by applying the one or more transient DC voltages or one or more transient DC voltage waveforms to all of the first electrodes.

42. A method of guiding ions according to claim 40, further comprising progressively or sequentially applying a DC or AC voltage to the first array of first electrodes wherein applying a DC or AC voltage includes providing a boundary and confining the ions within the ion guide such that the ions do not pass through the first array of first electrodes.

43. A method of ion mobility spectrometry or ion mobility separation conducted with a device comprising one or more layers of intermediate planar, plate or mesh electrodes arranged generally or substantially along a longitudinal axis of said device and in the plane in which ions travel and a first array of first electrodes disposed on a first side of said one or more layers of intermediate planar, plate or mesh electrodes, said method comprising:

progressively or sequentially applying one or more transient DC voltages or one or more transient DC voltage waveforms to said first array of first electrodes in order to urge, propel, force or accelerate at least some ions progressively along at least 60% of the longitudinal axis of said device; and causing the ions enter and exit the device along the axis.

44. A method of colliding, fragmenting or reacting ions with a device comprising one or more layers of intermediate planar, plate or mesh electrodes arranged generally or substantially along a longitudinal axis of said device and in the plane in which ions travel and a first array of first electrodes disposed on a first side of said one or more layers of intermediate planar, plate or mesh electrodes, said method comprising:

progressively or sequentially applying one or more transient DC voltages or one or more transient DC voltage waveforms to said first array of first electrodes in order to urge, propel, force or accelerate at least some ions progressively along at least 60% of the longitudinal axis of said device; and causing the ions enter and exit the device along the axis.

* * * * *